US012745845B2

(12) United States Patent
Kono et al.

(10) Patent No.: US 12,745,845 B2
(45) Date of Patent: Sep. 29, 2026

(54) CUSTOMIZABLE FOLDABLE CHAIR

(71) Applicant: Letsgetout Inc., Santa Monica, CA (US)

(72) Inventors: Ann Yee Kono, Santa Monica, CA (US); Laura Neidorf Rogers, Santa Monica, CA (US); David Randall Knott, Artarmon (AU); Philip John Patrick Rose, Artarmon (AU)

(73) Assignee: Letsgetout Inc., Los Angeles, CA (US)

( * ) Notice: Subject to any disclaimer, the term of this patent is extended or adjusted under 35 U.S.C. 154(b) by 83 days.

(21) Appl. No.: 18/722,463

(22) PCT Filed: Dec. 21, 2022

(86) PCT No.: PCT/US2022/082184
§ 371 (c)(1),
(2) Date: Jun. 20, 2024

(87) PCT Pub. No.: WO2023/122696
PCT Pub. Date: Jun. 29, 2023

(65) Prior Publication Data

US 2025/0151909 A1 May 15, 2025

Related U.S. Application Data

(60) Provisional application No. 63/293,298, filed on Dec. 23, 2021.

(51) Int. Cl.
*A47C 4/12* (2006.01)
*A47C 3/36* (2006.01)
(Continued)

(52) U.S. Cl.
CPC ..... *A47C 4/12* (2013.01); *A47C 3/36* (2013.01); *A47C 7/383* (2013.01); *A47C 7/624* (2018.08); *A47C 7/746* (2013.01); *A47C 31/11* (2013.01)

(58) Field of Classification Search
CPC .. A47C 4/12; A47C 3/36; A47C 7/383; A47C 7/38; A47C 7/624; A47C 7/62; A47C 7/746; A47C 7/74; A47C 31/11
(Continued)

(56) References Cited

U.S. PATENT DOCUMENTS 1,051,249 A 1/1913 Morton
2,127,398 A 8/1938 Freeman
(Continued)

FOREIGN PATENT DOCUMENTS

AU 202318156 1/2024
CN 203506111 U 4/2014
(Continued)

*Primary Examiner* — Justin V Lewis
(74) *Attorney, Agent, or Firm* — Knobbe Martens Olson & Bear LLP

(57) ABSTRACT

A foldable chair with a seat back and a seat bottom that is movable between a folded configuration where the seat bottom and seat back are adjacent each other and an unfolded configuration where the seat bottom extends generally perpendicular to the seat back. The foldable chair includes a cover that is removably coupleable to the seat bottom and/or seat back. The cover has a sleeve pocket that extends over the seat bottom or seat back and one or more straps extending from the edge of the front of the cover and wrapping around the edge of either the seat bottom or seat back. The straps include coupling members to connect to corresponding coupling elements on the back of the seat bottom or seat back. The foldable chair may also include connectors configured to receive accessories such as a parasol, cup holder, and/or book holder.

15 Claims, 26 Drawing Sheets

(51) Int. Cl.

| | |
|---|---|
| ***A47C 7/38*** | (2006.01) |
| ***A47C 7/62*** | (2006.01) |
| ***A47C 7/74*** | (2006.01) |
| ***A47C 31/11*** | (2006.01) |

(58) Field of Classification Search

USPC ..... 297/16.1, 19, 27, 28, 29, 30, 61, 68, 69, 297/70, 188.01, 188.14, 188.16, 188.18, 297/220, 227, 283.4, 391, 394, 411.2, 297/423.25, 423.34; 248/313

See application file for complete search history.

(56) References Cited

U.S. PATENT DOCUMENTS 2,201,964 A 5/1940 Alfons
2,581,793 A 1/1952 Hill
2,932,344 A 4/1960 Levi
3,033,511 A 5/1962 Clif
3,100,125 A 8/1963 Henri
4,025,107 A 5/1977 Chippa
4,057,291 A 11/1977 Dubinsky
4,125,286 A 11/1978 Redel
4,341,417 A 7/1982 Deconinck
4,456,294 A 6/1984 Lange et al.
D279,336 S 6/1985 Duncan
4,890,881 A 1/1990 Ollat et al.
4,892,353 A * 1/1990 Goddard ..... A47C 31/11 297/229
5,123,697 A 6/1992 Szczurek
5,244,249 A 9/1993 Tseng
5,282,664 A 2/1994 Tseng
5,449,220 A 9/1995 Taylor et al.
5,464,268 A 11/1995 Levrangi
5,803,539 A 9/1998 Dewar et al.
5,865,412 A 2/1999 Mason
6,056,172 A 5/2000 Welsh
6,056,353 A 5/2000 Meara
D440,784 S 4/2001 Ambasz
D453,080 S 1/2002 Lantigua et al.
D456,625 S 5/2002 Frenkler et al.
D482,205 S 11/2003 Englisch et al.
D485,083 S 1/2004 Frinier
6,871,911 B2 3/2005 Alexander, Jr.
6,974,185 B2 12/2005 Hsieh
7,014,264 B2 3/2006 Alderman et al.
7,025,421 B1 4/2006 Fowler et al.
D522,766 S 6/2006 Russell et al.
D547,981 S 8/2007 Cohen
7,341,310 B1 3/2008 Ross
7,374,247 B2 5/2008 Welsh et al.
D571,113 S 6/2008 Cohen
D571,115 S 6/2008 Cohen
7,396,073 B2 7/2008 Zheng
7,416,248 B2 8/2008 Rojas
D598,668 S 8/2009 Pluer
D621,632 S 8/2010 Ritter
8,061,766 B2 11/2011 Miller
D651,010 S 12/2011 Cohen
8,197,000 B1 6/2012 Cohen
8,474,916 B2 7/2013 Smith
8,499,380 B2 8/2013 Grace
D693,590 S 11/2013 Irvine
D696,657 S 12/2013 Cohen
8,667,907 B2 3/2014 Grace
D711,146 S 8/2014 Cohen
D711,147 S 8/2014 Cohen
8,794,703 B2 8/2014 Bateman et al.
8,857,352 B2 10/2014 Cohen
8,864,223 B2 10/2014 Larson et al.
D718,067 S 11/2014 Cohen
8,894,139 B1 11/2014 Coffey
8,905,471 B2 12/2014 Tang
RE45,417 E 3/2015 Smith
D725,424 S 3/2015 Cohen
8,979,184 B2 3/2015 Stafford et al.
8,991,913 B2 3/2015 Chen et al.
9,185,983 B1 11/2015 Cohen
9,247,817 B2 2/2016 Grace
D764,824 S 8/2016 Miller
9,532,654 B1 1/2017 Adams et al.
D778,629 S 2/2017 Gal
D798,626 S 10/2017 Cohen
9,788,673 B2 10/2017 Gschwind, Jr.
D802,956 S 11/2017 Neil
D803,595 S 11/2017 Holland
D804,878 S 12/2017 Nakamura et al.
D805,317 S 12/2017 Lowsky
D806,423 S 1/2018 Silva et al.
9,949,565 B1 4/2018 Huang et al.
D837,002 S 1/2019 Nichols
10,194,749 B1 2/2019 Doolan et al.
D843,150 S 3/2019 Doolan et al.
D843,151 S 3/2019 Doolan et al.
D843,152 S 3/2019 Doolan et al.
10,299,599 B2 5/2019 Browning et al.
10,321,750 B2 6/2019 Solomon et al.
10,342,354 B2 7/2019 Partridge
10,368,649 B2 8/2019 Cohen
10,405,659 B2 9/2019 Garrison et al.
10,405,662 B2 9/2019 Cohen
D867,044 S 11/2019 Cohen
10,499,743 B2 12/2019 Frankel et al.
10,561,249 B2 2/2020 Doolan et al.
10,602,845 B2 3/2020 Mason et al.
D880,920 S 4/2020 Cohen
10,610,020 B2 4/2020 Garrison et al.
10,631,651 B1 4/2020 Besner et al.
10,722,034 B2 7/2020 Winterhalter et al.
10,722,037 B2 7/2020 Pendleton, Jr.
10,743,670 B2 8/2020 Winterhalter et al.
D902,617 S 11/2020 Sullivan et al.
10,874,219 B2 12/2020 Winterhalter et al.
10,905,224 B2 2/2021 Solomon et al.
10,925,783 B2 2/2021 Epstein
D911,730 S 3/2021 Doolan et al.
D911,731 S 3/2021 Sullivan et al.
D911,733 S 3/2021 Sullivan et al.
D912,423 S 3/2021 Sullivan et al.
10,959,525 B2 3/2021 Browning et al.
10,959,527 B2 3/2021 Orde
11,064,810 B2 7/2021 Snir et al.
D929,142 S 8/2021 Sullivan et al.
D941,600 S 1/2022 Sullivan et al.
D955,131 S 6/2022 Sullivan et al.
D955,132 S 6/2022 Sullivan et al.
D974,786 S 1/2023 Kono et al.
2003/0025360 A1 2/2003 Liu
2006/0214476 A1 9/2006 Rojas
2007/0045496 A1* 3/2007 Kane ..... A47G 23/0225 248/313
2007/0236054 A1 10/2007 Bateman et al.
2008/0203773 A1 8/2008 Bateman et al.
2009/0146468 A1 6/2009 Schneider
2010/0207429 A1* 8/2010 Quinn ..... A47C 7/664 297/16.1
2010/0314914 A1 12/2010 Mazzola et al.
2011/0121619 A1 5/2011 Chappell
2011/0298263 A1 12/2011 Bateman et al.
2015/0084381 A1 3/2015 Nelson
2015/0327675 A1 11/2015 Fenner
2015/0366357 A1 12/2015 Nelson
2016/0100688 A1 4/2016 Grace
2016/0135600 A1* 5/2016 Chen ..... A47C 1/0265 297/42
2018/0338623 A1 11/2018 Winterhalter et al.
2019/0350364 A1 11/2019 Yang
2020/0054139 A1 2/2020 Morley, Jr.
2020/0076351 A1 3/2020 Belverio
2020/0187656 A1 6/2020 Winterhalter et al.
2020/0187660 A1 6/2020 Leia et al.
2020/0214450 A1 7/2020 Garrison
2020/0214451 A1 7/2020 Garrison
2020/0229604 A1 7/2020 Garrison et al.
2020/0383481 A1 12/2020 Cieszko et al.

(56) References Cited

U.S. PATENT DOCUMENTS

| | | | |
|---|---|---|---|
| 2021/0015263 | A1 | 1/2021 | Lah |
| 2021/0037980 | A1 | 2/2021 | Besner et al. |
| 2021/0112987 | A1 | 4/2021 | Winterhalter et al. |

FOREIGN PATENT DOCUMENTS

| | | | |
|---|---|---|---|
| CN | 203749017 | U | 8/2014 |
| EM | 0150426700001 | | 12/2023 |
| EM | 0150426700002 | | 12/2023 |
| GB | 633079 | A | 12/1949 |
| GB | 633080 | A | 12/1949 |
| JP | S6086620 | U | 6/1985 |
| KR | 10-1506728 | B1 | 3/2015 |
| WO | WO 2023/122696 | A1 | 6/2023 |

* cited by examiner

CUSTOMIZABLE FOLDABLE CHAIR

CROSS-REFERENCE TO RELATED APPLICATIONS

Any and all applications for which a foreign or domestic priority claim is identified in the Application Data Sheet as filed with the present application are hereby incorporated by reference under 37 CFR 1.57.

BACKGROUND

Field

The present disclosure is directed to a foldable chair, and more particularly to a customizable foldable chair that has connectors for cup holders, book holders, and parasols, as well as a frame with removable covers.

Description of Related Art

Chairs come in a variety of different styles and can be used for different settings. For example, dining chairs are used to comfortably eat at a table while office chairs are used to work at a desk, and beach chairs or camping chairs can be used outdoors. Traditionally, chairs used for outdoor activities do not have the necessary structure or support to assist users during common outdoor tasks, such as eating a meal. As a result, individuals are often forced to use makeshift solutions, or require users to use multiple separate components. These solutions are often unstable and prone to failure, leading to spills, accidents, and inconvenience. Additionally, if a chair gets damaged (e.g., the seat gets stained, or the seat material rips) the entire chair must be replaced. Furthermore, some chairs may be overly specialized. These overspecialized chairs may be bulky, large, and expensive. Bulky chairs may also be difficult to transport, carry, and store. Some chairs may be used more for their aesthetic features than their functionality. For example, some chairs are used to accent the style of a room or patio. Thus, users may need to buy multiple chairs for different environments and tasks.

SUMMARY

In some aspects, the techniques described herein relate to a foldable chair, including: a seat back and a seat bottom, the foldable chair movable between a folded configuration where the seat bottom and seat back are generally adjacent to each other and a seating configuration where the seat bottom extends generally perpendicular to the seat back; a first cover removably coupleable to the seat bottom having a first sleeve pocket that extends over at least a portion of the seat bottom and one or more straps extending from one or more edges of a front of the first cover and wrapping around an edge of the seat bottom, the straps including coupling members configured to couple to corresponding coupling elements on an underside of the seat bottom or a back of the first cover to couple the first cover to the seat bottom: a second cover removably coupleable to the seat back having a second sleeve pocket that extends over at least a portion of the seat back and one or more straps extending from one or more edges of a front of the second cover and wrapping around an edge of the seat back, the straps including coupling members configured to couple to corresponding coupling elements on a back of the seat back or a back of the second cover to couple the second cover to the seat back; and a pair of front legs coupled to a pair of rear legs via a hinge mechanism and attached to a left and right side of the foldable chair.

In some aspects, the techniques described herein relate to a foldable chair, wherein the foldable chair further includes a locking mechanism, wherein the locking mechanism is selectively unlocked by actuating a release tag.

In some aspects, the techniques described herein relate to a foldable chair, wherein the release tag is attached to a pull wire attached to one or more spring-loaded pins, wherein the one or more spring-loaded pins have corresponding slots that restrict a movement of the corresponding one or more pins, and wherein actuating the release tag disengages the one or more spring-loaded pins from the corresponding slots.

In some aspects, the techniques described herein relate to a foldable chair, wherein the coupling members of the first cover and the second cover are elastic hoops, and wherein the coupling elements on the back of the seat bottom and the seat back are protrusions configured to couple to the elastic hoops.

In some aspects, the techniques described herein relate to a foldable chair, wherein the coupling members on the first cover and the second cover are separable magnet fasteners configured to couple to the corresponding coupling elements on the back of the seat bottom and seat back or on opposite surfaces of the first cover and the second cover.

In some aspects, the techniques described herein relate to a foldable chair, wherein the seat back includes one or more top connectors, wherein the one or more top connectors are configured to resiliently couple to a parasol.

In some aspects, the techniques described herein relate to a foldable chair, wherein the parasol is collapsible.

In some aspects, the techniques described herein relate to a foldable chair, wherein the foldable chair further includes of a pair of arm rests, wherein the arm rests include of one or more connectors that are located on a distal portion of the arm rests.

In some aspects, the techniques described herein relate to a foldable chair, wherein the one or more connectors are located on an underside of the arm rests.

In some aspects, the techniques described herein relate to a foldable chair, including: a frame including a seat back and a seat bottom, the frame movable between a folded configuration where the seat bottom and seat back are generally adjacent to each other and a seating configuration where the seat bottom extends generally perpendicular to the seat back; a pair of front legs coupled to a pair of rear legs via a hinge mechanism and attached to a left and right side of the seat bottom; and one or more connectors, at least one of the one or more connectors being on the seat back or seat bottom of the frame that are configured to removably couple to an accessory.

In some aspects, the techniques described herein relate to a foldable chair, wherein the foldable chair further includes a locking mechanism, wherein the locking mechanism may be unlocked by actuating a release tag.

In some aspects, the techniques described herein relate to a foldable chair, wherein the release tag is attached to a pull wire attached to one or more spring-loaded pins, wherein the one or more spring-loaded pins have corresponding slots that restrict a movement of the corresponding spring-loaded pin, and wherein actuating the release tag disengages the one or more spring-loaded pins from the corresponding slots.

In some aspects, the techniques described herein relate to a foldable chair, wherein the foldable chair further includes a locking mechanism, wherein the locking mechanism automatically locks when either the folded configuration or the primary seating configuration is reached.

In some aspects, the techniques described herein relate to a foldable chair, wherein the one or more connectors located on a top portion of the seat back, wherein the one or more connectors are configured to couple to a parasol.

In some aspects, the techniques described herein relate to a foldable chair, wherein the foldable chair further includes of a pair of arm rests, wherein the one or more connectors include a connector located on a distal portion of one arm rest of the pair of arm rests.

In some aspects, the techniques described herein relate to a foldable chair, wherein the connector located on the distal portion of the arm rest is located on an underside of the arm rest.

In some aspects, the techniques described herein relate to a foldable chair, wherein the connector is configured to receive a cup holder.

In some aspects, the techniques described herein relate to a cover removably coupleable to a chair, the cover including: a first cover portion removably coupleable to a seat bottom having a first sleeve pocket that extends over at least a portion of the seat bottom and one or more straps extending from one or more edges of a front of the first cover portion and wrapping around an edge of the seat bottom, the straps including coupling members configured to couple to corresponding coupling elements on a back of the first cover portion or on an underside of the seat bottom to resiliently couple the first cover portion to the seat bottom; and a second cover portion removably coupleable to a seat back having a second sleeve pocket that extends over at least a portion of the seat back and one or more straps extending from one or more edges of a front of the second cover portion and wrapping around an edge of the seat back, the straps including coupling members configured to couple to corresponding coupling elements on a back of the second cover portion or on a back of the seat back to resiliently couple the second cover portion to the seat back.

In some aspects, the techniques described herein relate to a cover, wherein the first cover portion and the second cover portion are made of a mesh material.

In some aspects, the techniques described herein relate to a cover, wherein the coupling members of the first cover portion and the second cover portion are elastic hoops, and wherein the coupling elements on the back of the first cover portion and the second cover portion are protrusions configured to resiliently couple to the elastic hoops.

In some aspects, the techniques described herein relate to a cover, wherein the coupling members of the first cover and the second cover are separable magnet fasteners configured to resiliently couple to corresponding coupling elements on the back of the first cover and the second cover.

In some aspects, the techniques described herein relate to a cover, wherein the one or more coupling members on the front of the first cover portion and the second cover portion are snap-fit fasteners configured to resiliently couple to corresponding coupling elements on the back of the first cover portion and the second cover portion.

In some aspects, the techniques described herein relate to a cover, wherein the coupling members of the first cover and the second cover are a first side of a zipper configured to resiliently couple to corresponding coupling elements on the back of the first cover and the second cover, wherein the corresponding coupling elements are a second side of the zipper

DETAILED DESCRIPTION

The present disclosure describes various implementations of a foldable chair. The foldable chair can be put in a folded configuration or an unfolded configuration. The multiple configurations make the foldable chair convenient to store, transport, and use. In the folded position, the chair takes up much less space than a standard chair (e.g., a non-foldable chair). The foldable chair is also easier to carry in the folded position. Additionally, the folded chair is less awkward to carry than a standard chair. The foldable chair is also made of lightweight components and materials (e.g., a plastic material) which reduce the chair's weight. Once a user is done transporting the foldable chair, the user can easily use the release tab to unlock the chair, as further described below. Once the chair is unfolded, the foldable chair can automatically lock into the unfolded position.

The foldable chair is also customizable to improve the experience and comfort of a user. For example, the foldable chair supports attachments such as a cup holder, book holder, and parasol or sun shade, where the cup holder and parasol can be adjustable (e.g., between different positions or orientations). Additionally, the foldable chair may have removable covers. The removable covers are made of a fabric (e.g., a mesh fabric, a cloth fabric, etc.). Thus, a user can remove and replace the cover if the fabric gets damaged. Additionally, the user can replace the fabric to personalize their chair. For example, a custom cover may include the logo of the user's alma mater, favorite sports team or have other images or insignia (e.g., a picture of the user's beloved family pet). Furthermore, the foldable chair has a seat back that can be adjusted to a number of reclined positions. The user can disengage a lock to adjust the seat back. For example, the user can lift the chair's arm rests to disengage the lock, move the seat back backwards to recline, and reengage the arm rests to a frame of the chair to lock the reclined position of the chair.

Figure 1:
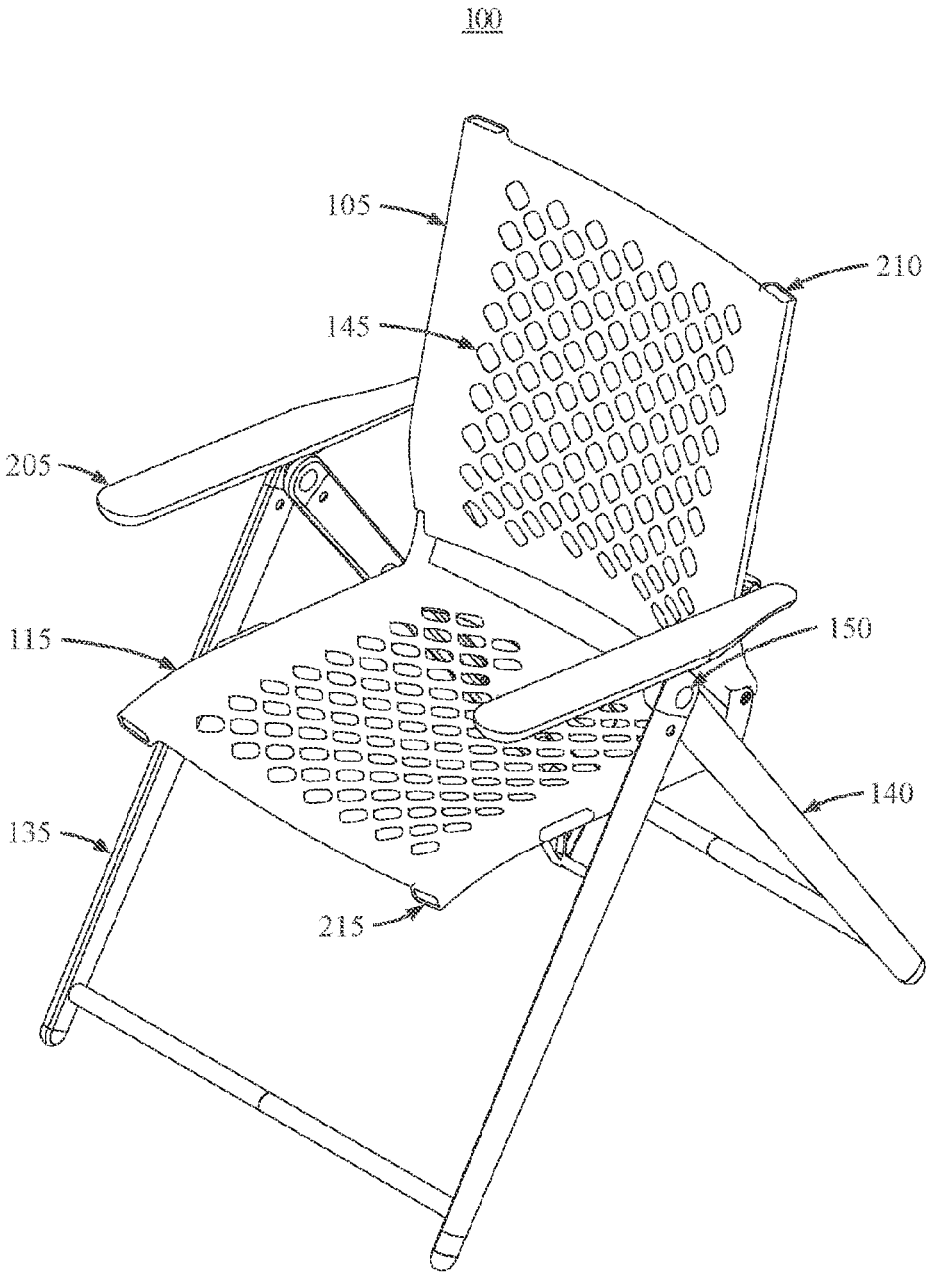
FIG. 1 and FIG. 2 illustrate a front and back perspective view, respectively, of the foldable chair in an unfolded configuration (e.g., a primary seating configuration).
Figure 2:
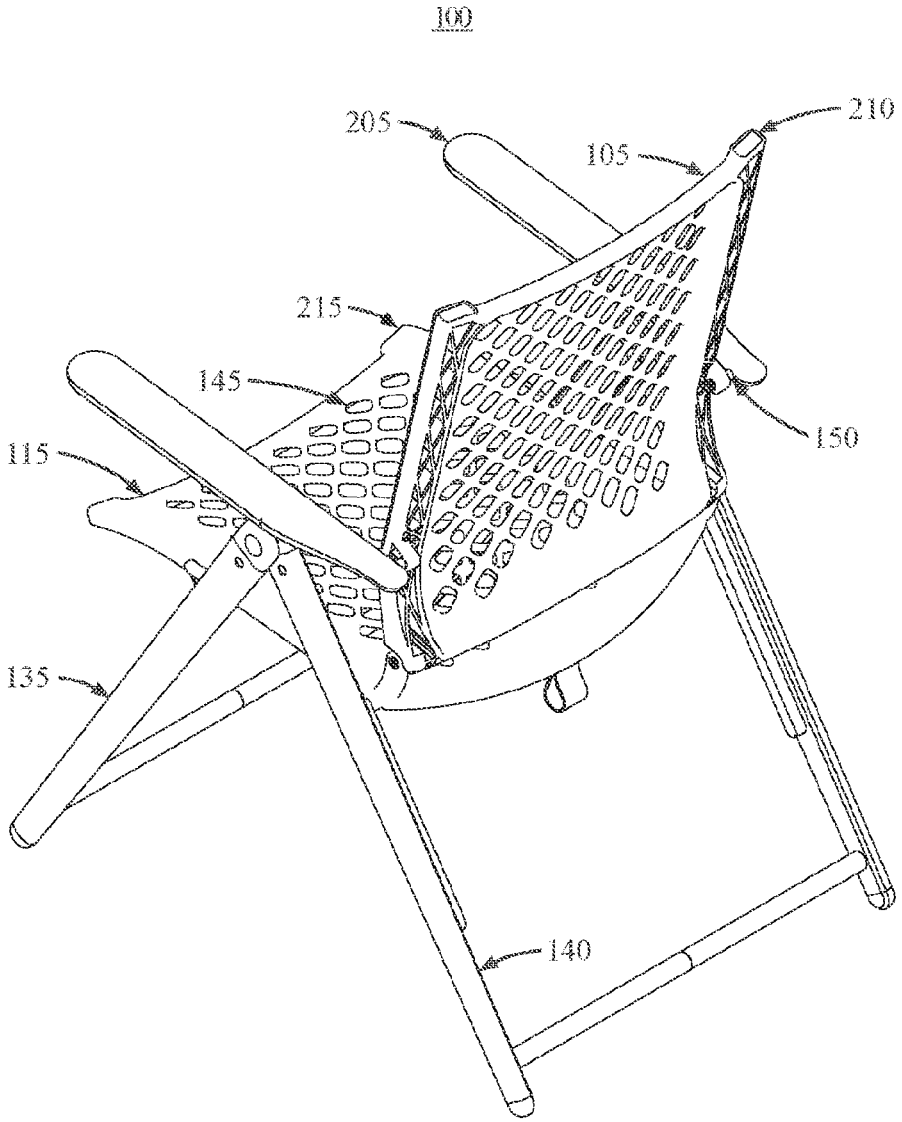

FIG. 1 and FIG. 2 illustrate a front and back perspective view, respectively, of the foldable chair 100 in an unfolded configuration (e.g., a primary seating configuration). In some embodiments, the foldable chair 100 has a seat back 105, a seat bottom 115, front legs 135, and back legs 140. In some embodiments, the foldable chair 100 has a sled base (not shown). For example, the left front leg 135 may connect to the left back leg 140, and the right front leg 135 may connect to the right back leg 140. Similarly, the left front leg 135 may connect to the right front leg 140, and the right back leg 135 may connect to the left back leg 140. The connections between the front legs 135 and the back legs 140 may run along the supporting surface (e.g., the ground) to provide more support and balance for the foldable chair 100. In some embodiments, the seat back 105, seat bottom 115, front legs 135, and back legs 140 are made of a lightweight and durable material, such as carbon fiber or aluminum. The foldable chair 100 components can also, or alternatively, be made of wood, plastic, metal, wicker, or a composite. Overall, the durability of the foldable chair 100 allows the foldable chair 100 to support weights up to approximately 110-190 kilograms (kg), such as about 160 kg.

In some embodiments, the foldable chair 100 can have a pair of arm rests 205. The arm rests 205 can be removably attached to the seat back 105 and/or a first hinge 150. Alternatively, or in addition, the arm rests 205 may be attached to the seat bottom 115. The arm rests 205 can be made of fabric, plastic, rubber, wood, carbon fiber, metal, or a composite material. The arm rests 205 may also be made from a combination of these materials (e.g., fabric-covered wood). Regardless of the material, the arm rests 205 allow a user to position (e.g., support) his or her arms more comfortably while seated on the chair 100. Overall, the arm rests 205 may reduce the strain on the shoulder and back of a user by allowing the user to sit in a healthier position.

The seat back 105 and seat bottom 115 may have perforated surfaces. For example, the seat back 105 and seat bottom 115 may have a pattern of spaced holes 145 (e.g., regularly spaced holes) that have been punched, drilled, or otherwise created through the material (e.g., entirely through the thickness of the seat back 105 and/or seat bottom 115). The holes 145 may be of uniform size and shape, or they may vary in size and shape. In some embodiments, only a portion of the seat back 105 and seat bottom 115 are perforated surfaces. The repeating holes 145 in the seat back 105 and seat bottom 115 can be useful for a variety of purposes, such as allowing air to pass therethrough to keep the user cool when seated on the chair 100, allowing water to pass therethrough due to rain or a liquid spill, providing a decorative pattern, or reducing the weight of the foldable chair 100. In some embodiments, the one or more of the holes 145 may be connectors designed to allow attachments, accessories, or additions to be securely connected, as further discussed below.

The foldable chair 100 may additionally, or alternatively, have one or more (e.g., a pair of) top connectors 210, and one or more (e.g., a pair of) bottom connectors 215. In some embodiments, the top connectors 210 are built into the seat back 105 (e.g., at a top end of the seat back 105), and the bottom connectors 215 are built into the seat bottom 115 (e.g., at a front end of the seat bottom 115). The connectors 210, 215 improve the experience of a user by allowing the user to customize the foldable chair 100 according to his or her preferences. For example, these connectors 210, 215 allow a user to connect accessories to the seat back 105 and seat bottom 115 of the foldable chair 100. The connectors 210, 215 will be described in more detail below. In some implementations, the connectors 210, 215 can include openings or female shaped recesses that can receive a male shaped connector of one or more accessories described herein. In other implementations, the connectors 210, 215 can include male shaped connectors that can extend into openings or female shaped connectors of one or more accessories described herein.

Figure 3:
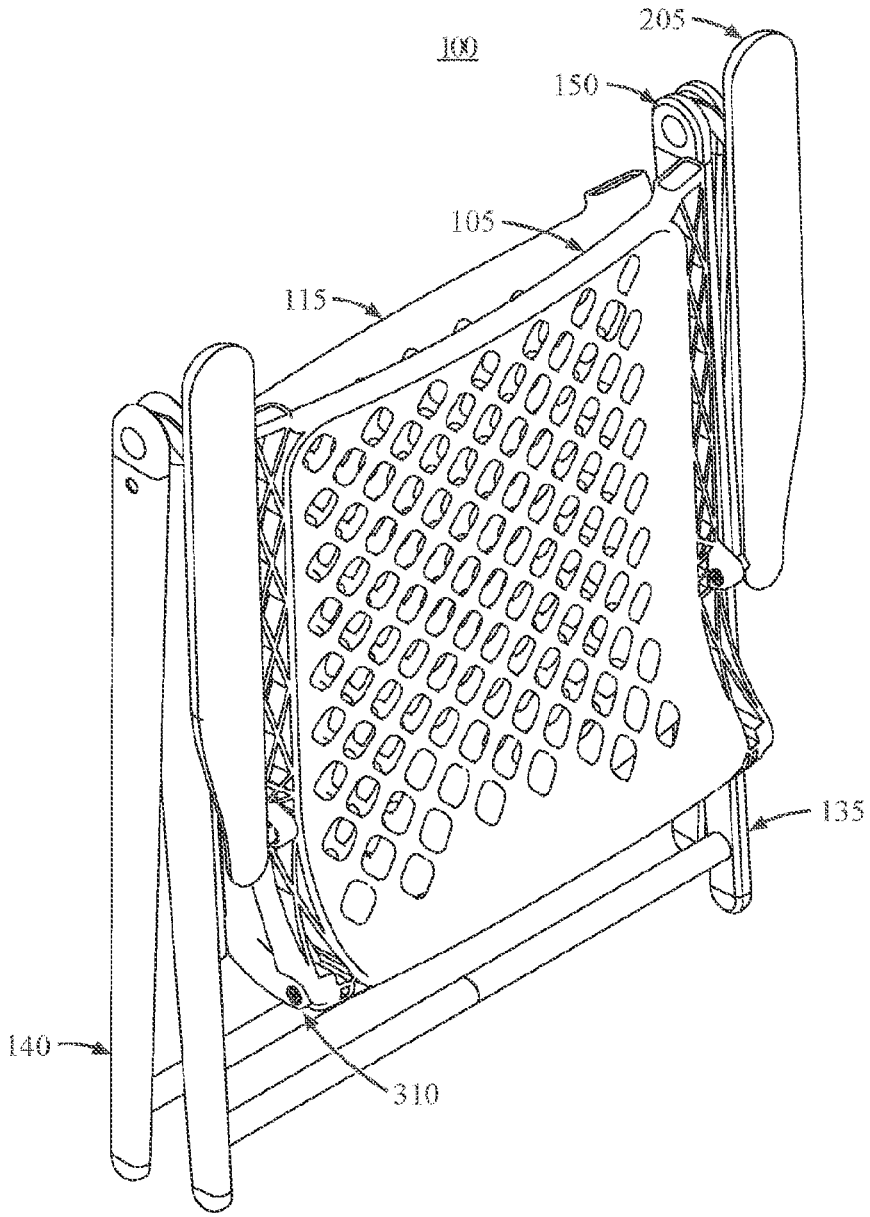
FIG. 3 and FIG. 4 illustrate a front and back perspective view, respectively, of the foldable chair of FIG. 1 in a folded configuration.
Figure 4:
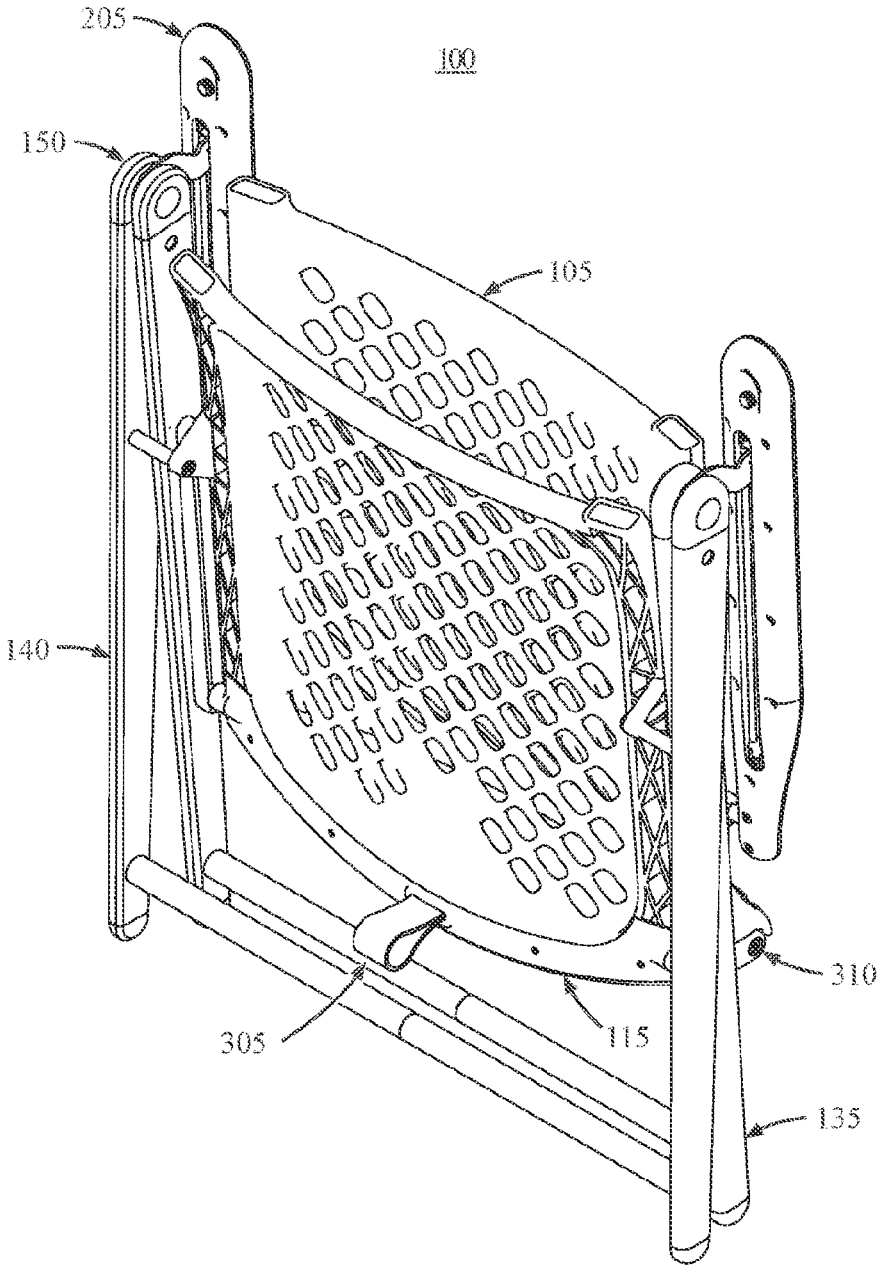

FIG. 3 and FIG. 4 illustrate a front and back perspective view, respectively, of the foldable chair 100 in a folded configuration. In some embodiments, the front legs 135 and back legs 140 may be connected via the first hinge 150. Similarly, the seat back 105 and seat bottom 115 may be connected via a second hinge 310. Thus, the different components of the foldable chair 100 can be adjusted (e.g., rotated) independently of each other. The independent movement of the foldable chair 100 components allows the foldable chair 100 to be positioned in different configurations. For example, the foldable chair 100 can be put into an unfolded configuration by increasing the angle between the front legs 135 and back legs 140 and between the seat back 105 and the seat bottom 115. Similarly, by aligning the different foldable chair 100 components (e.g., the seat back 105, seat bottom 115, front legs 135, and back legs 140), the foldable chair 100 can be moved into a folded configuration. In some embodiments, the seat back 105, seat bottom 115, front legs 135, and back legs 140 are generally parallel when the foldable chair 100 is in the folded configuration. The folded configuration may reduce the size of the foldable chair 100 and make the foldable chair 100 easier to store and carry. For example, the folded configuration allows a user to carry a chair with only one hand. In some embodiments, the foldable chair 100 has a handle or shoulder straps, which makes the foldable chair 100 convenient to carry (e.g., with one hand or carried on the user's back). Additionally, or alternatively, the foldable chairs 100 may be designed to be stackable while in either a folded or unfolded configuration.

In some embodiments, the foldable chair 100 can be locked in the folded or unfolded configuration to inhibit (e.g., prevent) the foldable chair 100 from unexpectedly folding or unfolding (e.g., when it is being carried, stored, or used). The foldable chair 100 may lock automatically when it reaches either the folded or unfolded configuration. In some embodiments, the foldable chair 100 has a release tag 305 that unlocks the position of the foldable chair 100. The release tag 305 may be a small, thin piece of material (e.g., fabric, leather, mesh, plastic, etc.) that is attached to the foldable chair 100 in a way that allows a user to easily pull the release tag 305.

In some embodiments, when a user pulls the release tag 305, it activates a mechanism that unlocks the foldable chair 100 and allows it to be folded or unfolded. For example, to unfold the unlocked foldable chair 100, the user may rotate the seat back 105 away from the seat bottom 115 until the seat back 105 locks into place. In some embodiments, the foldable chair 100 can be unfolded with only one hand. For example, the foldable chair 100 may have springs and dampers (not shown) which push the foldable chair 100 open. In some embodiments, the foldable chair 100 springs open when the release tag 305 is pulled or a button is pressed. Overall, the folding/unfolding process is efficient and simple.

Figure 5:
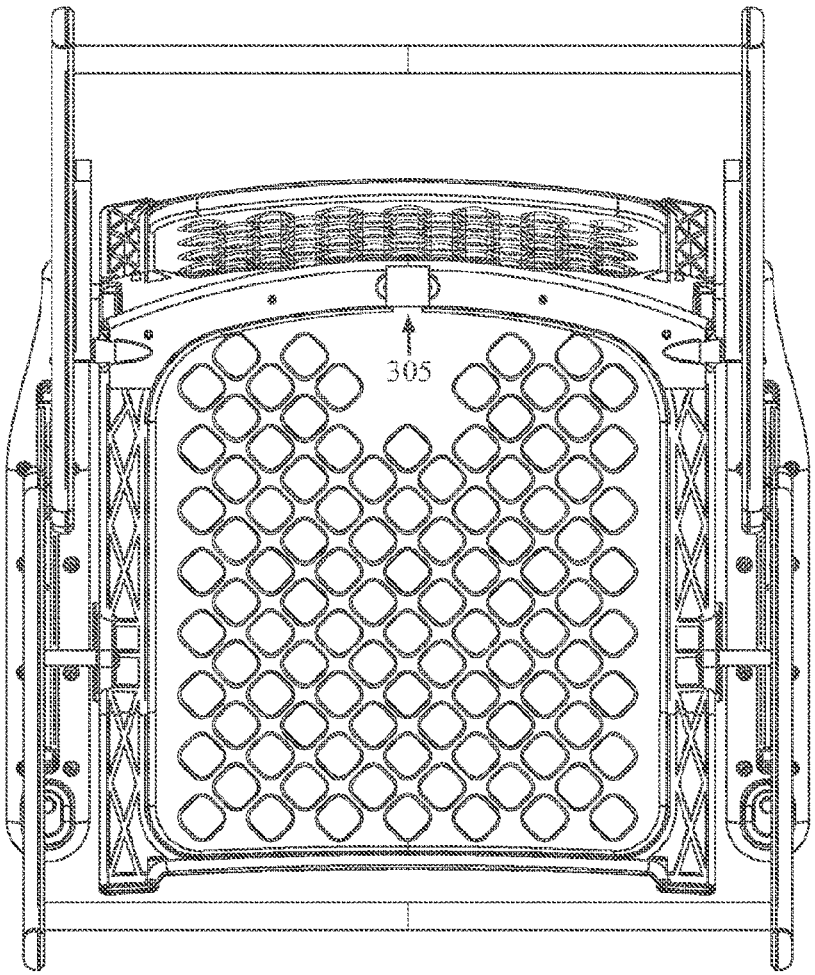
FIG. 5 illustrates a bottom view of the foldable chair of FIG. 1.
Figure 6:
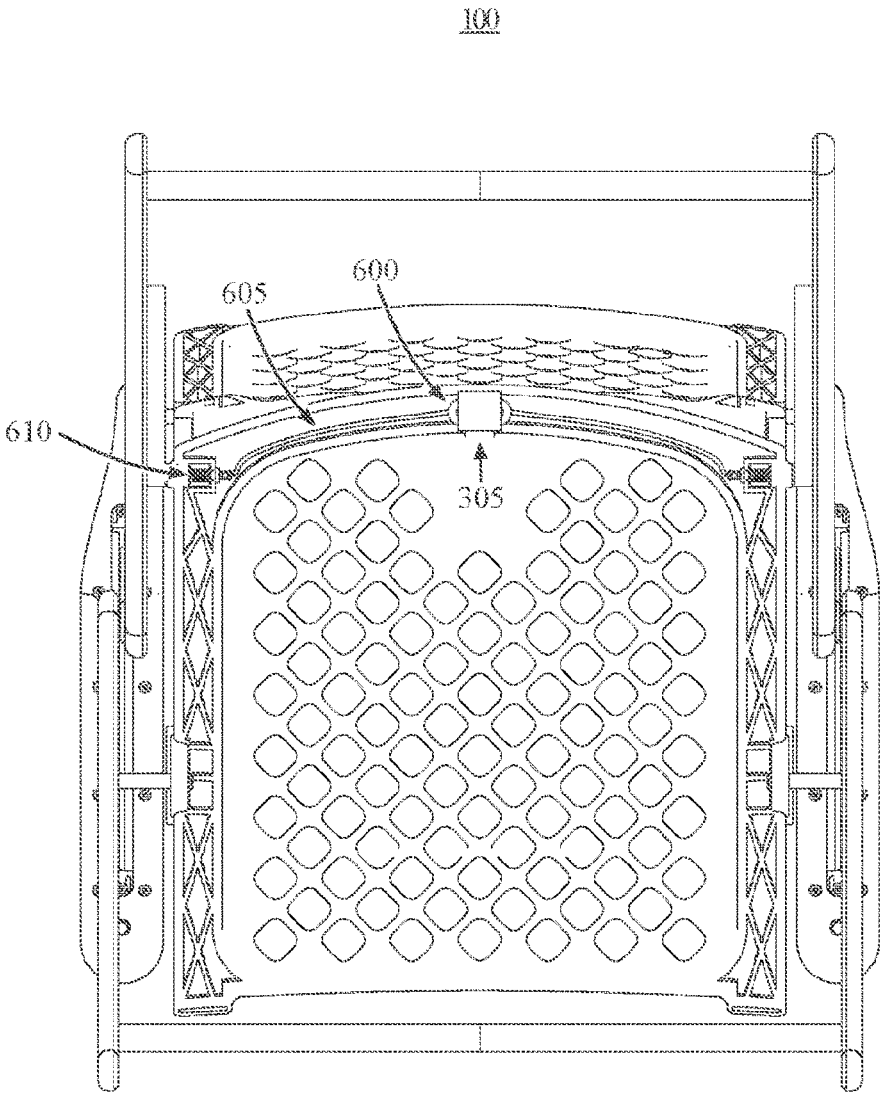
FIG. 6 illustrates a bottom view of the foldable chair of FIG. 1 with a portion of the bottom cover removed.
Figure 7:
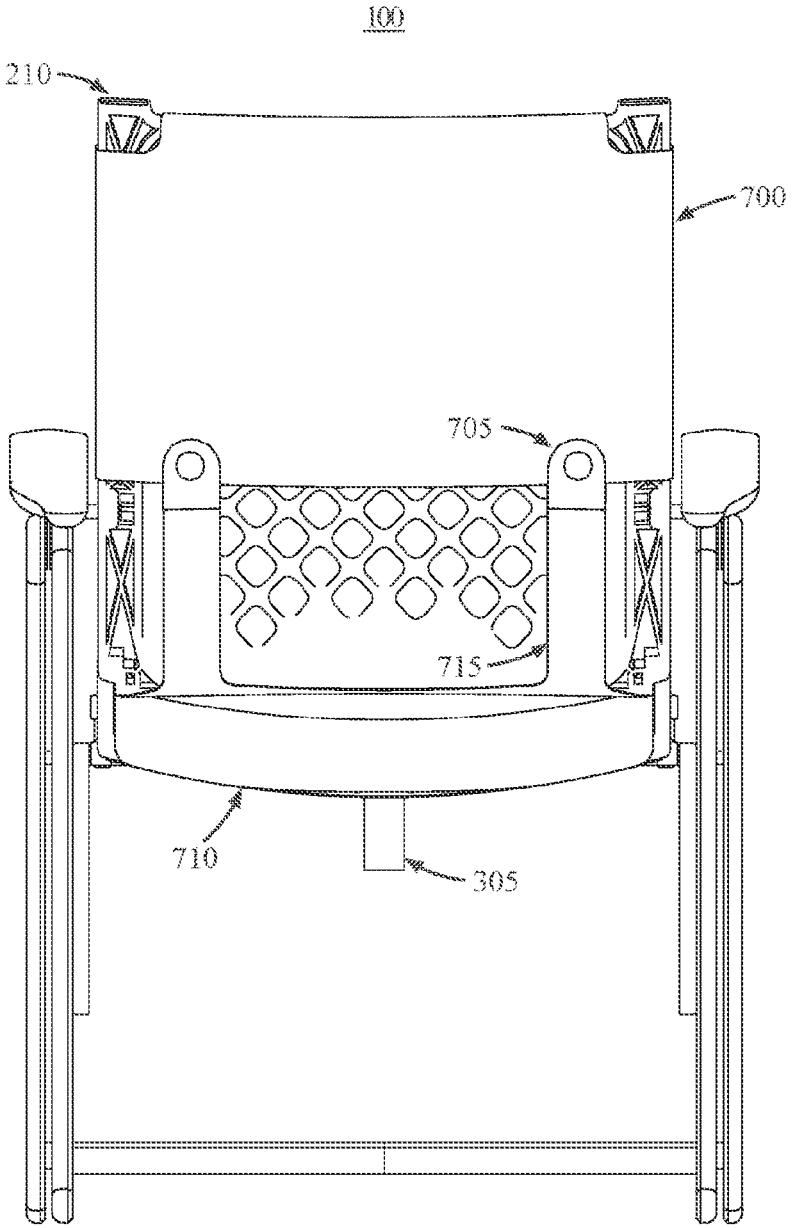
FIGS. 7-10 illustrate the foldable chair of FIG. 1 with detachable covers attached to the seat back and the seat bottom.
Figure 8:
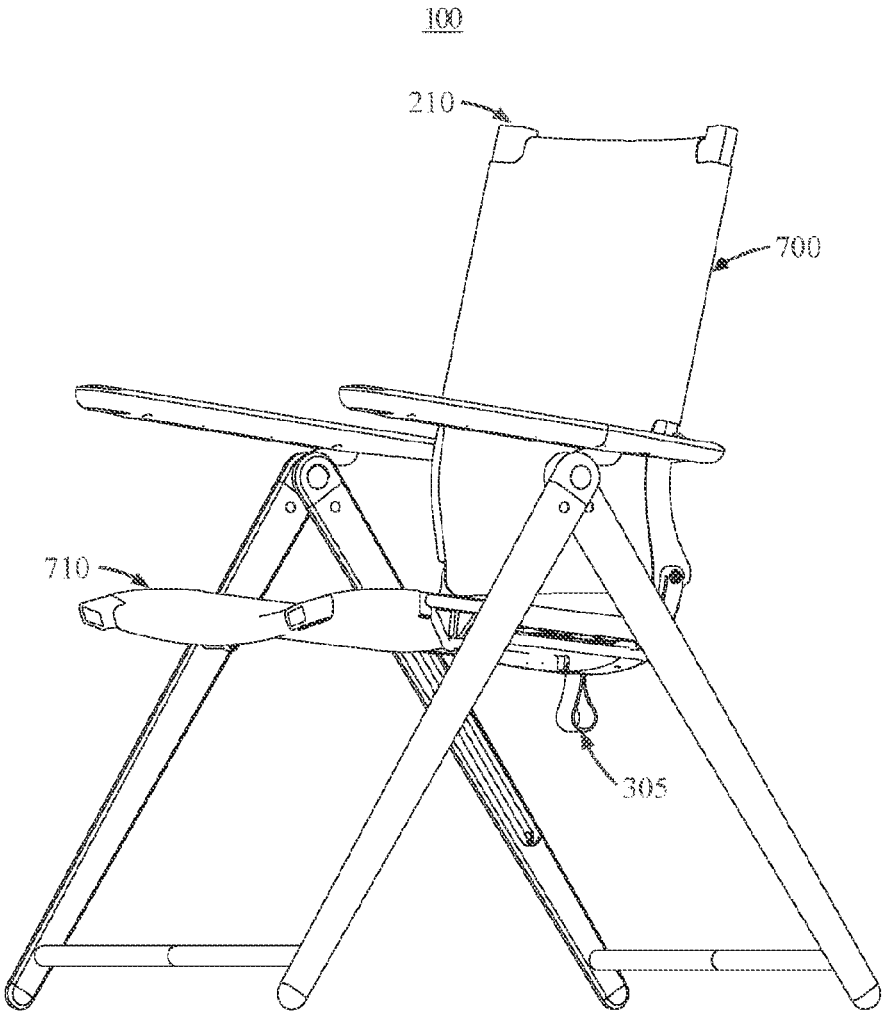
Figure 9:
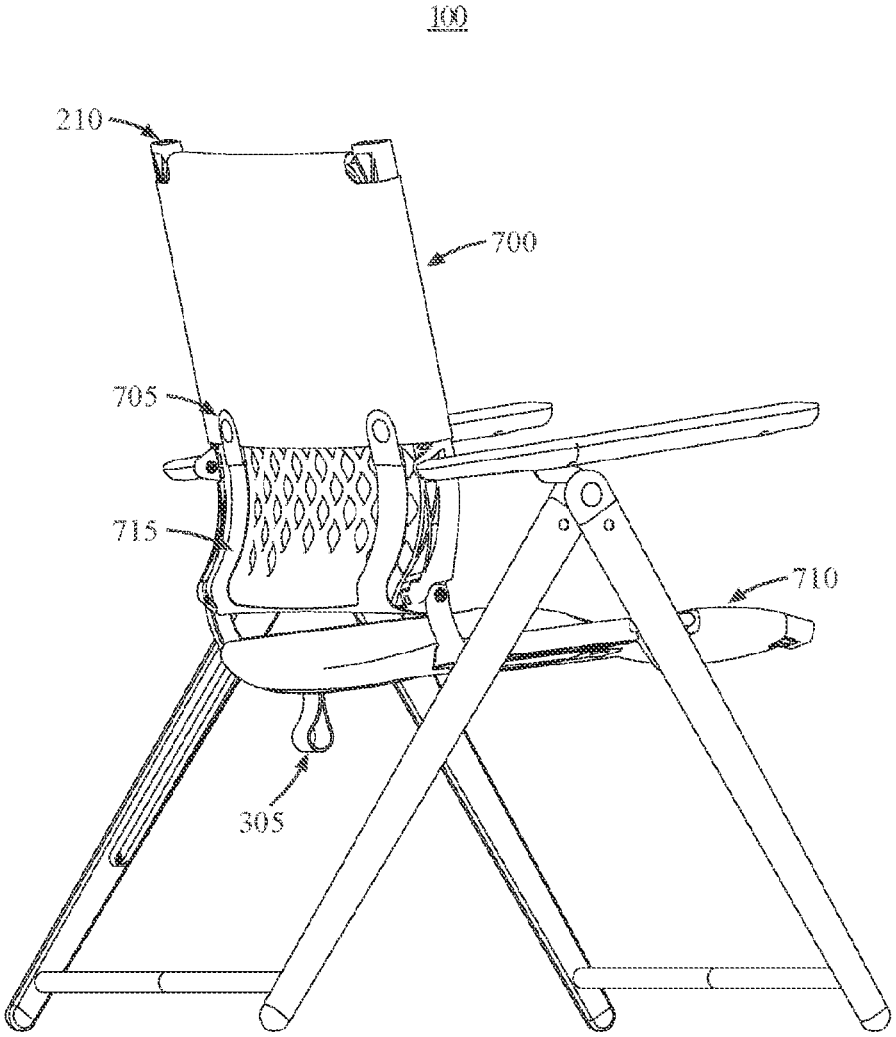
Figure 10:
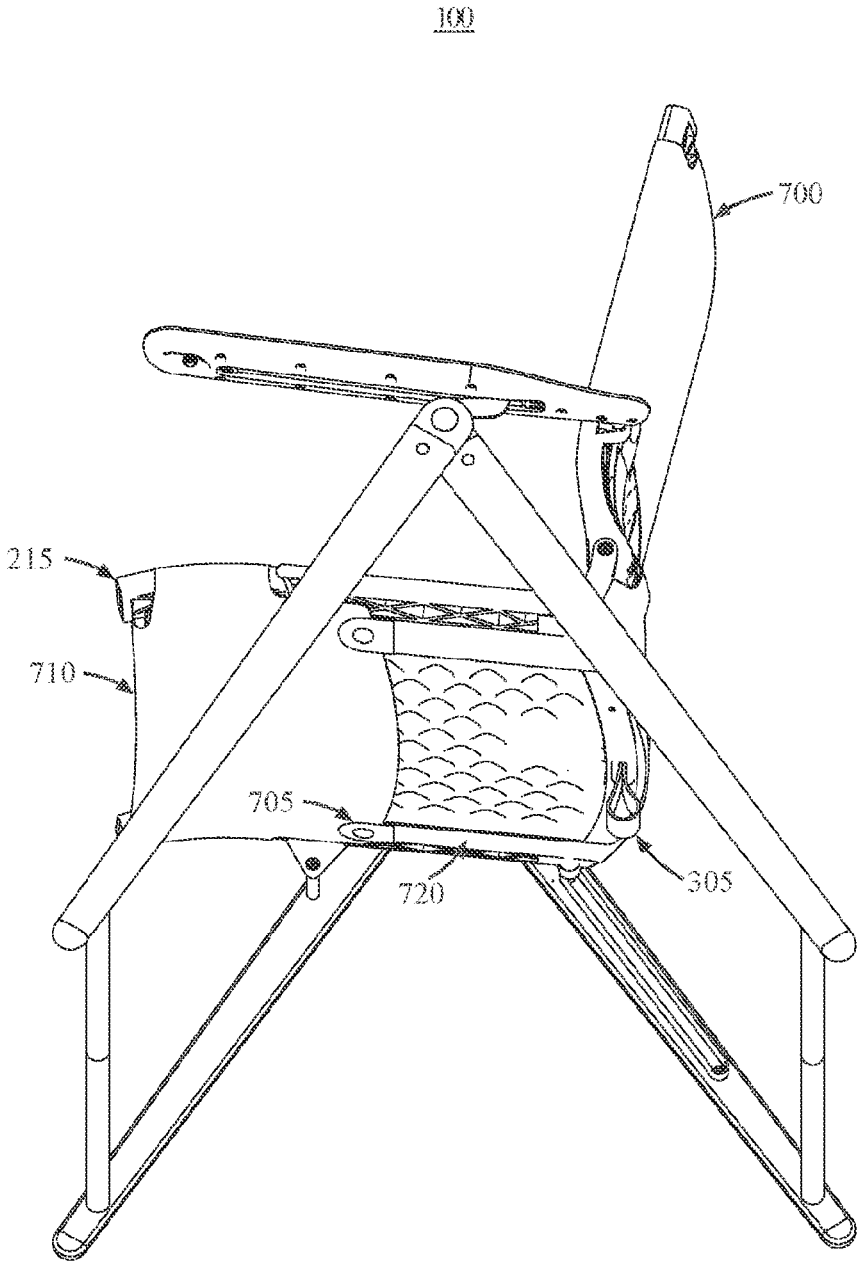

FIG. 5 illustrates a bottom view of the foldable chair 100. Similarly, FIG. 6 illustrates a bottom view of the foldable chair 100 with a portion of the bottom cover removed. Thus. FIG. 6 illustrates one embodiment of the locking mechanism 600. In some embodiments, the locking mechanism includes the release tag 305, one or more pull wires 605, and one or more spring-loaded pins 610. The release tag 305 may be connected to two pull wires 605. Each pull wire 605 may be connected to a spring-loaded pin 610. Thus, when a user pulls the release tag 305 the spring-loaded pins 610 may be pulled from their corresponding pin slots (e.g., to unlock the position of the chair 100, such as a folded configuration, and allow it to be moved into a different position, such as an unfolded configuration, and vice versa). In some embodiments, the foldable chair 100 had two sets of pin slots (not shown). For example, one set of pin slots may correspond to the folded configuration and a second set of pin slots may correspond to the unfolded configuration.

FIGS. 7-10 illustrate the foldable chair 100 with detachable covers 700, 710 or skins removably attached to the seat back 105 and the seat bottom 115, respectively. The detachable covers 700, 710 can be separate from each other (e.g., not form a single cover that goes over the seat bottom 115 and seat back 105). In some embodiments, detachable covers 700, 710 can be made from a variety of materials, including natural fabrics such as cotton, linen, bamboo, rattan, wicker, mesh, leather, tweed, and wool, as well as synthetic fabrics such as polyester, nylon, and spandex. The choice of material can depend on the desired look and feel of the detachable covers 700, 710, as well as the intended use and desired level of durability. For example, detachable covers 700, 710 made from a natural fabric such as cotton may be more breathable and comfortable to sit on, while detachable covers 700, 710 made from a synthetic material such as nylon, polyester webbing strips, and marine grade acrylic may be more durable and resistant to stains. Additionally, some detachable covers 700, 710 may be made from a combination of different materials, such as a cotton-polyester blend, to achieve the user's desired properties. In some embodiments, the seat back cover 700 and the seat bottom cover 710 have additional padding and/or are weatherproof (e.g., waterproof and UV resistant). Furthermore, the detachable covers 700, 710 may allow the user to customize the foldable chair 100 with a desired design (e.g., logo, insignia, such as that of a favorite sports team or alma mater, etc.) and allow the user to easily change designs. Additionally, the detachable covers 700, 710 allow the user to easily repair a damaged or worn-out cover.

In some embodiments, each detachable covers 700, 710 has sleeve pockets. The sleeve pockets can extend over at least a portion of the seat back 105 and/or seat bottom 115. Alternatively, the sleeve pocket may cover the entire seat back 105 and/or seat bottom 115. In some embodiments, the detachable covers 700, 710 have openings for the top connectors 210 and bottom connectors 215. Thus, the connectors 210, 215 may be accessible (e.g., exposed, uncovered) when the detachable covers 700, 710 are attached to the foldable chair 100.

One or both of the detachable covers 700, 710 may have straps 715, 720 respectively, that connect the front of the detachable cover 700, 710 to the back of the detachable covers 700, 710. The straps 715, 720 may wrap around the seat back 105 or seat bottom 115 to attach the detachable cover 700, 710 to the corresponding portion of the foldable chair 100. In some embodiments, a strap 715, 720) may have a coupling member 705 that corresponds to a coupling element on the sleeve pocket of the detachable cover 700, 710. The coupling member 705 may be or include a magnet that corresponds to a magnetically receptive surface (e.g., the coupling element) on the back of a detachable cover 700, 710. Thus, a user may be able to easily attach and remove the detachable covers 700, 710. Alternatively, or in addition, the coupling member 705 may be a snap-fit fastener, hook and loop fasteners, a zipper, or a threaded fastener. Additionally, some embodiments, may use a combination of one or more of the coupling methods (e.g., magnet and snap fits).

Figure 26:
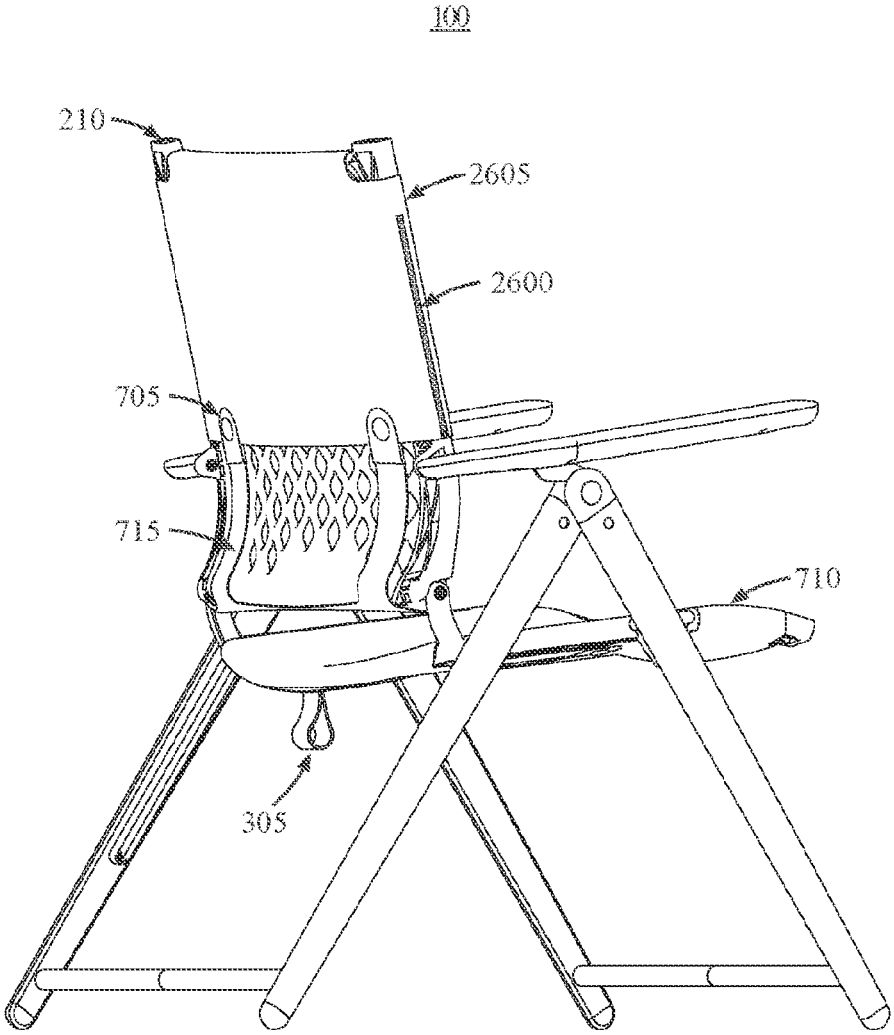
FIG. 26 illustrates one embodiment of the foldable chair 100 with a detachable cover that has a zipper.

For example, FIG. 26 illustrates one embodiment of the foldable chair 100 with a detachable cover 2605 that has a zipper 2600. The zipper 2600 may be used to resiliently couple the detachable cover 2605 to the foldable chair 100. In some embodiments, the detachable cover 2605 includes the straps 715 with coupling members 705. Alternatively, some embodiments of the detachable cover 2605 may use a zipper as the only coupling element (e.g., some detachable covers may not have straps). Alternatively, or in addition, the zipper 2600 may be positioned down the middle of the detachable cover 2605 or on the top of the detachable cover 2605. In some embodiments, the detachable cover 2605 may have more than one zipper (e.g., a zipper on each side) or one continuous zipper that is located across three sides of the detachable cover 2650 (e.g., the zipper is on a first side, the top, and a second side). Though FIG. 26 shows the zipper 2600 on the side of detachable cover 2605 for the seat back 105, one of skill in the art will recognize that the detachable cover 710 for the seat bottom 115 can similarly have a zipper that may be used to attach the detachable cover 710 to the seat bottom 115.

Figure 11:
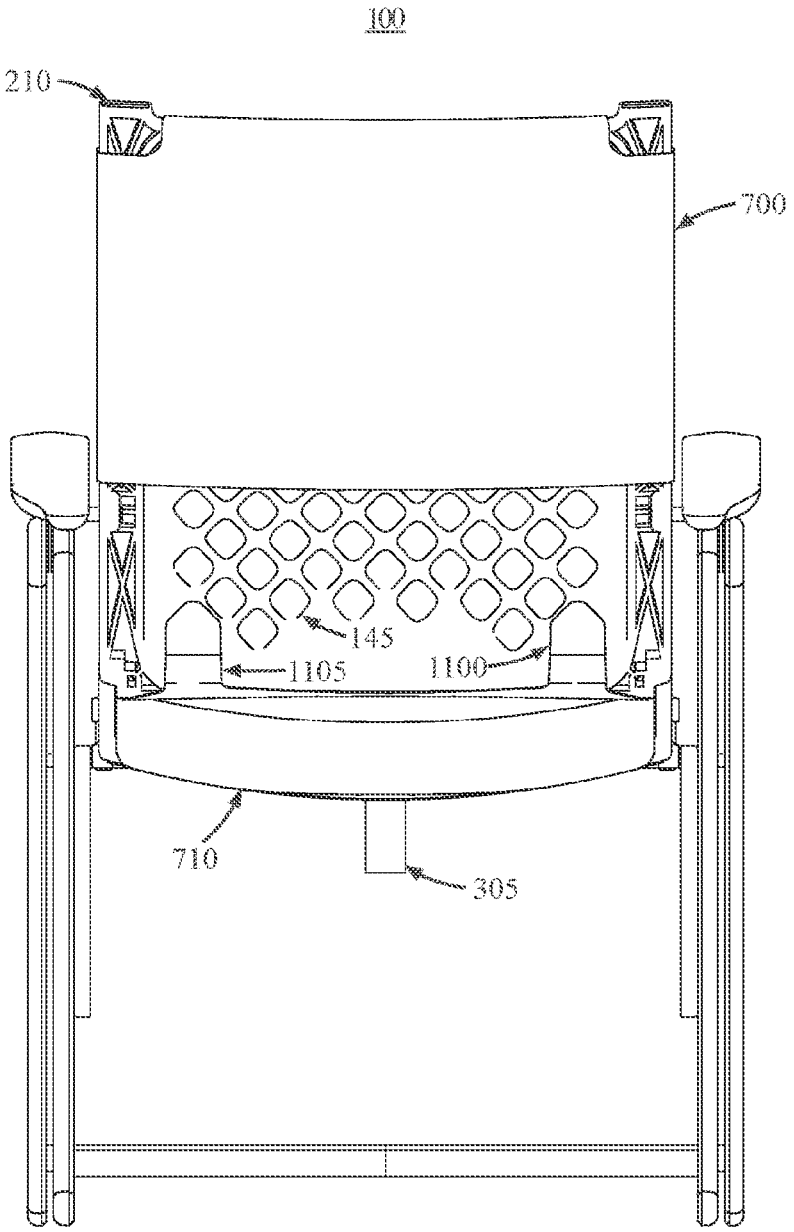
FIGS. 11-12 illustrate the foldable chair of FIG. 1 with detachable covers that have coupling members that attach to the perforated holes.
Figure 12:
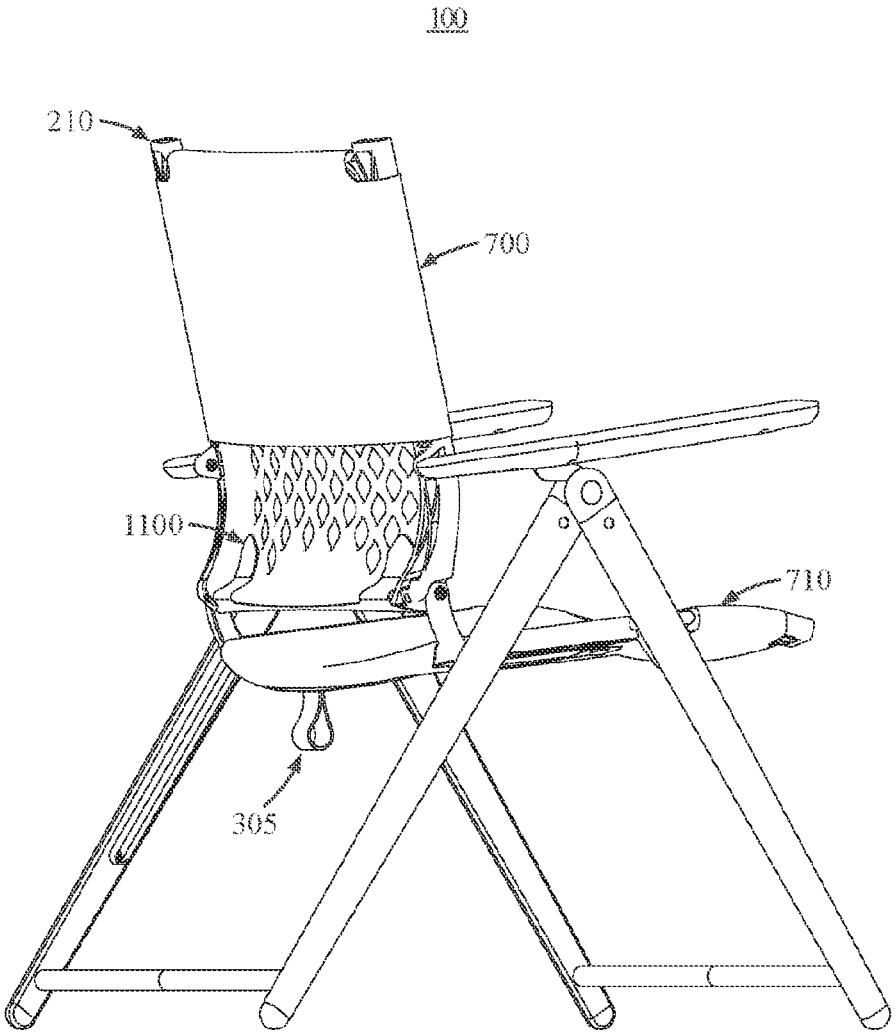

Alternatively, or in addition, the coupling member on the strap 715, 720 may attach to a hole 145 of the perforated surface of the foldable chair 100. FIGS. 11-12 illustrate the foldable chair 100 with detachable covers 700, 710 that have coupling members 1100 that attach (e.g., in a press-fit or friction-fit manner) to the perforated holes 145. For example, the coupling member 1100 may be the projection portion of a snap-fit coupling while the hole 145 may be the recess portion of the snap-fit. Thus, a user may easily push the coupling member 1100 into the hole 145 (e.g., the coupling element) to securely attach the detachable cover 700, 710 to the foldable chair 100. Similarly, the user may easily pull the coupling member 1100 from the hole 145 to remove the detachable cover 700, 710. Alternatively, or in addition, the coupling member 1100 may be a magnet that corresponds to a magnetically receptive surface corresponding to one or more of the holes 145. Furthermore, the coupling member 1100 may be a snap-fit fastener, a hook and loop fastener, or a threaded fastener. Though FIGS. 11-12 show the coupling members 1100 attached to the straps 1105 of the detachable cover 700 for the seat back 105, one of skill in the art will recognize that the detachable cover 710 for the seat bottom 115 can similarly have straps with coupling members 1100 that couple to perforated holes 145 in the seat bottom 115. In another implementation, the cover 710 for the seat bottom 115 can have coupling members 705 attached to its straps 720. In still another implementation, the detachable cover 710 for the seat bottom 115 can have straps with coupling members 1100 that couple to perforated holes 145 in the seat bottom 115, and the detachable cover 700 for the seat back 105 can have straps 715 with coupling members 705.

Figure 13:
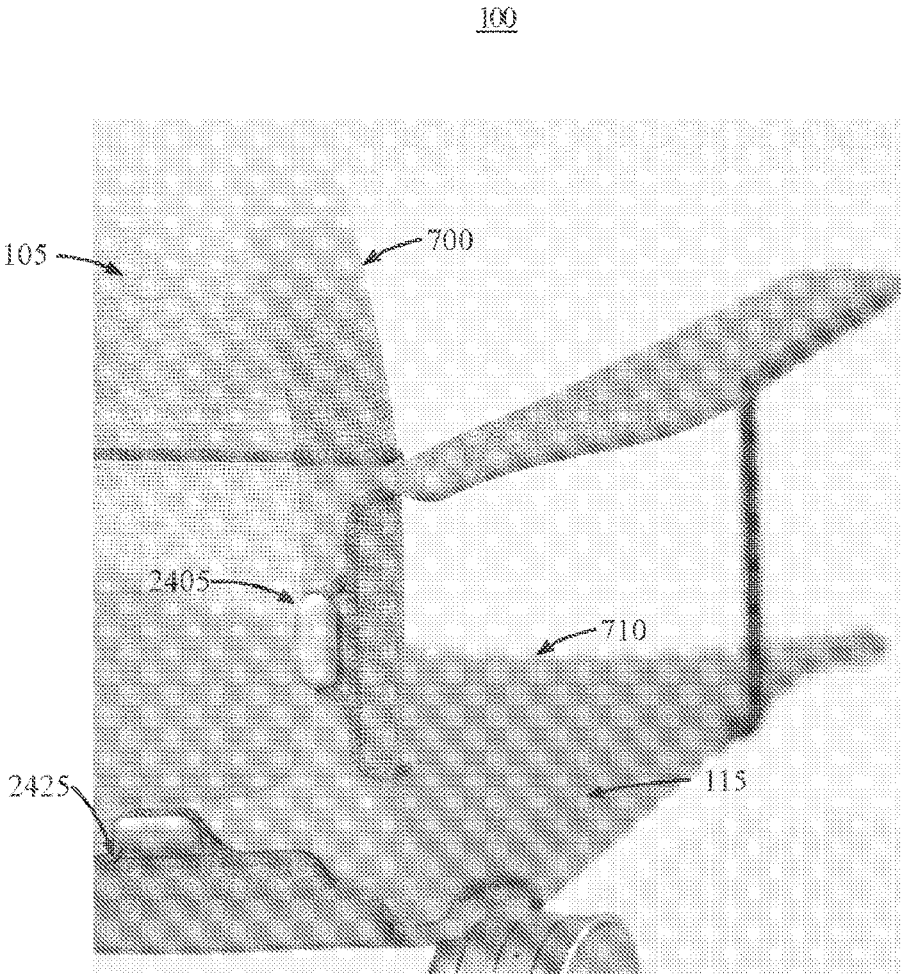
FIG. 13 illustrate one embodiment of the foldable chair with detachable covers that have coupling members that attach to elastic coupling members.

FIG. 13 illustrate one embodiment of the foldable chair 100 with detachable covers 700, 710 that have coupling members 2425 that attach to (e.g., elastically or resiliently couple to) coupling elements 2405 on the seat back 105 and seat bottom 115. The coupling members 2425 can resiliently couple to corresponding coupling elements 2405 on the surface of the chair frames (e.g., the seat back 105 and/or seat bottom 115). In some embodiments, the detachable covers 700, 710 have one to six elastic coupling members 2425, such as four. Similarly, in some embodiments, the seat bottom 115 and seat back 105 have one to six coupling elements 2405, such as four. In some embodiments, the elastic coupling members 2425 are elastic hoops and the coupling elements 2405 are knobs or tabs (e.g., protrusions). Thus, to couple the detachable covers 700, 710 to the foldable chair 100, a user may wrap the elastic hoops around the corresponding knobs, which allows the detachable covers 700, 710 to be pulled taut. In some embodiments, the foldable chair 100 may use a combination of coupling methods. For example, the seat back cover 700 may use magnetic clasps that attach to the seat back cover 700 while the seat bottom cover 710 uses snap-fit coupling members that attach to a hole 145 of the foldable chair 100. However, any combination of the coupling members and coupling elements described herein may be used to attach the detachable covers 700, 710 to the foldable chair 100.

In some embodiments, the seat back cover 700 and seat bottom cover 710 can be a single continuous cover that attaches to both the seat bottom 115 and seat back 105. The single continuous cover may have one or more sleeve pockets. The one or more sleeve pockets can extend over at least a portion of the seat bottom 115 and/or the seat back 105. The single continuous cover can have one or more coupling members, such as coupling members 705, 1100, 2425 described above.

Figure 14:
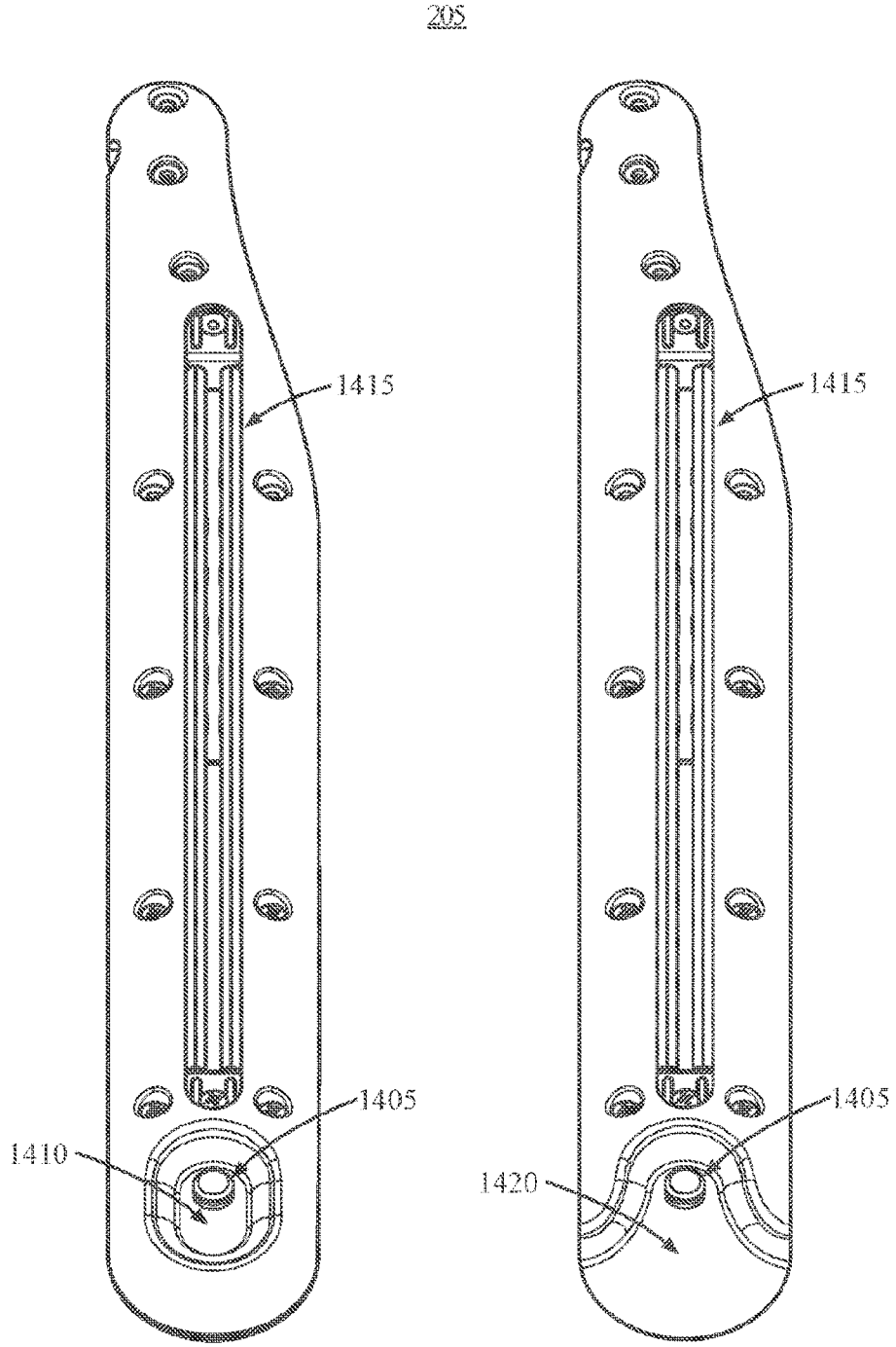
FIG. 14 illustrate a bottom perspective view of two embodiments of the arm rest of the foldable chair of FIG. 1.

FIG. 14 illustrate a bottom perspective view of two embodiments of the arm rest 205 of the foldable chair 100. In some embodiments, the arm rest 205 may have a connector 1405, a recessed area 1410 or 1420, and a sliding slot 1415. The sliding slot 1415 may be used to rotate the arm rest in relation to the first hinge 150 and the front and back legs 140 (see FIG. 4). In the illustrated examples, the connector 1405 is a male shaped element that can couple to an opening or female shaped connector of an accessory (e.g., a cup holder). In other implementations, the connector 1405 can alternatively be a female shaped element that can couple to a male shaped connector of an accessory.

Furthermore, in some embodiments, the connectors 210, 215, and 1405 may be used to attach a variety of detachable accessories to the foldable chair 100. For example, the foldable chair 100 can be customized with one or more of the following: parasols or sun shade. Bluetooth speakers, lights, small tables. GPS trackers, book holders, hooks (e.g., for holding a bag or other item), or battery packs. Overall, the connectors 210, 215, and 1405 allow the foldable chair 100 to be easily customized to a user's preference. The connectors 210, 215 and 1405 may use a friction fit, snap fit, or magnets to couple to the accessories. Additionally, in some embodiments, the connectors 210, 215 and connector 1405 may use screws, latches, or buckles to couple to accessories. The connectors 210, 215, and 1405 may also, or alternatively, use keyed connectors (e.g., key-slot connectors) that lock into place when the corresponding connectors of the accessories are inserted in the correct orientation. In some embodiments, the connectors 210, 215, and 1405 use a combinations of attachment methods (e.g., a magnetic friction fit). Additionally, the connection between the foldable chair 100 and the accessories may be dynamic or static. For example, some accessories may be adjusted (e.g., in orientation or position) after they have been connected to the foldable chair 100.

Figure 15:
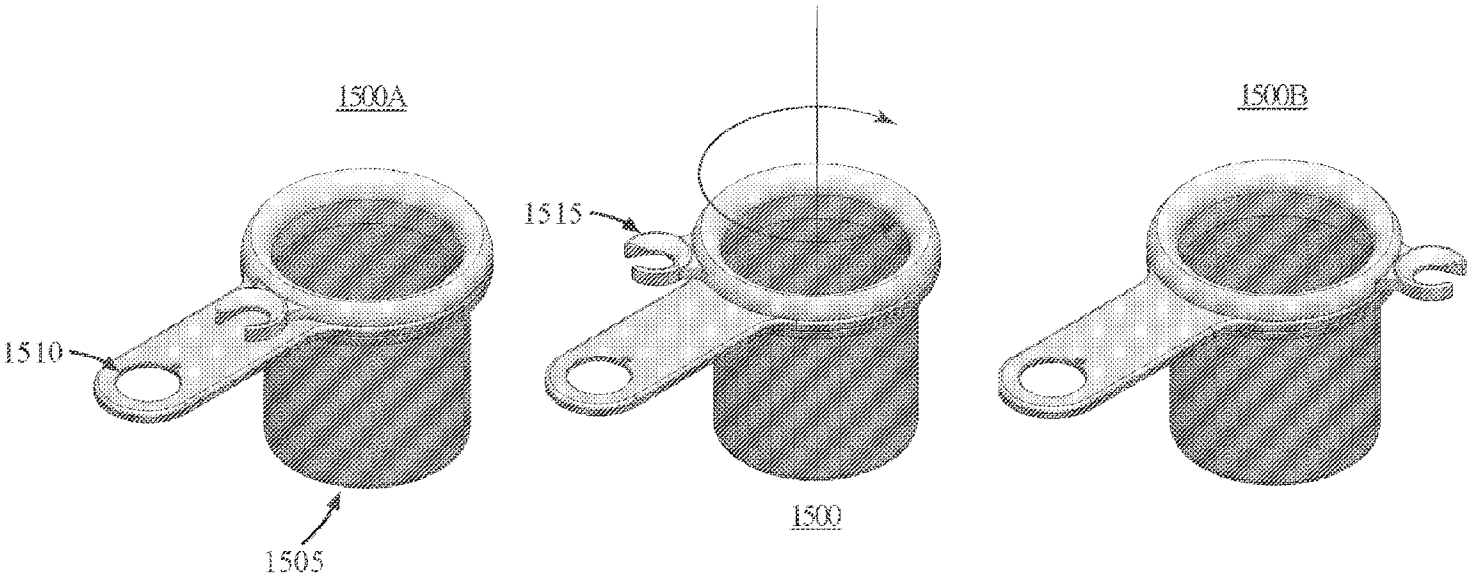
FIG. 15 illustrates a cup holder 1500 accessory for the foldable chair of FIG. 1.

FIG. 15 illustrates a cup holder 1500 accessory for the foldable chair 100. The cup holder 1500 may a main body 1505 with a coupling member 1510 for securing the cup holder 1500 to the foldable chair 100. The main body 1505 may have a circular opening for holding a standard-sized cup or bottle. In some embodiments, the cup holder 1500 has a rotating wine glass holder 1515, which can securely hold a wine glass (e.g., the wine glass holder 1515 has an opening that receives a stem of a wine glass therein). The wine glass holder 1515 can rotate 360 degrees. In some embodiments, a user can rotate the wine glass holder 1515 into a closed position 1500A when storing the cup holder 1500 and into an open position 1500B when using the wine glass holder 1515. The cup holder 1500 may be made of lightweight and durable materials that can withstand the weight of a cup or wine glass. For example, the cup holder 1500 may be made of metal, plastic, composites, or any other suitable materials. The main body 1505 of the cup holder 1500 may also have a mesh body. The mesh body may allow for easy cleaning of the cup holder, as any spills or debris can simply be brushed or rinsed away. The mesh body may be made of a flexible and durable material, such as a stainless steel, fabric, or plastic mesh. Thus, the cup holder 1500 may be a convenient and practical accessory for users who enjoy drinking while sitting in the foldable chair 100.

In some embodiments, the accessories have a protruded area that corresponds to the recessed area 1410 of the arm rest 205. For example, the coupling member 1510 may be placed on the protruded area. Alternatively, or in addition, the recessed area 1420 may extend until the end of the arm rest 205 to create a generally planar or flat surface for the coupling member 1510 of the accessories. In some embodiments, the recessed area 1420 may allow the attached accessory to rotate while it is attached to the foldable chair 100. For example, a user may rotate the cup holder 1500 into a closer or further position while it is attached (e.g., adjust the position of the cup holder 1500 between one where the main body 1505 is aligned and in front of the arm rest 205 and a position where the cup holder 1500 is not aligned and offset to the side, such as offset laterally, relative to the arm rest 205).

Figure 16:
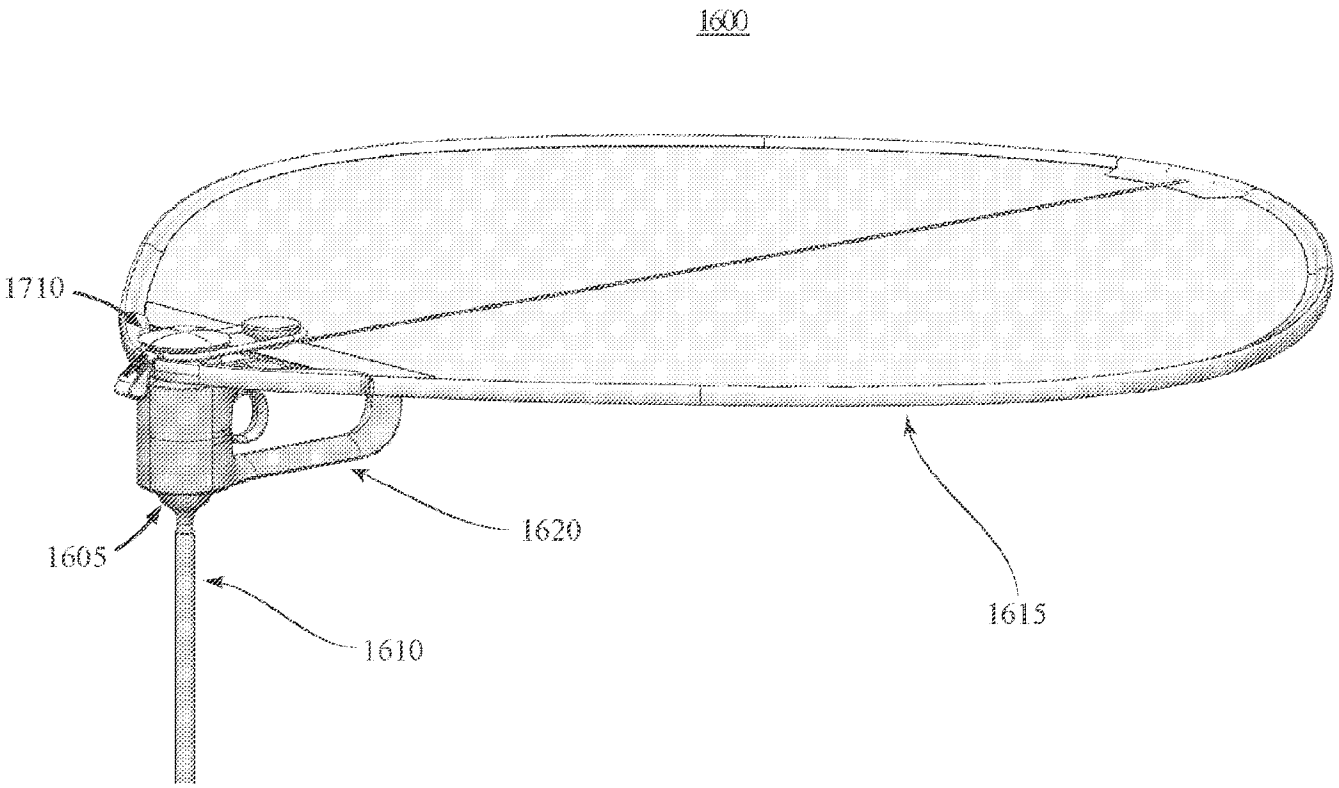
FIG. 16 illustrates a parasol accessory for the foldable chair of FIG. 1.

FIG. 16 illustrates a parasol 1600 accessory or sun shade for the foldable chair 100. The parasol 1600 may be used to provide shade and protection from the sun and other elements, such as rain. In some embodiments, the parasol 1600 is a portable and expandable parasol that has a canopy 1615 that can be mounted on a joint 1605 (e.g., a ball joint). The canopy 1615 may be made of a weather-resistant material such as nylon or polyester. Alternatively, or in addition, the canopy 1615 may be made of any natural or synthetic material listed above. The joint 1605 may allow the parasol 1600 to rotate 360 degrees along the primary elongated axis (e.g., the axis extending along the length of the supporting rod 1610, which is parallel to the ground when the parasol 1600 is standing upright). Furthermore, the joint 1605 may allow the parasol 1600 to rotate 270 degrees or more along the secondary axis (the axis that is perpendicular to the primary elongated axis). Advantageously, the joint 1605 allows the user to adjust the parasol to provide shade and protection at various angles.

Figure 17:
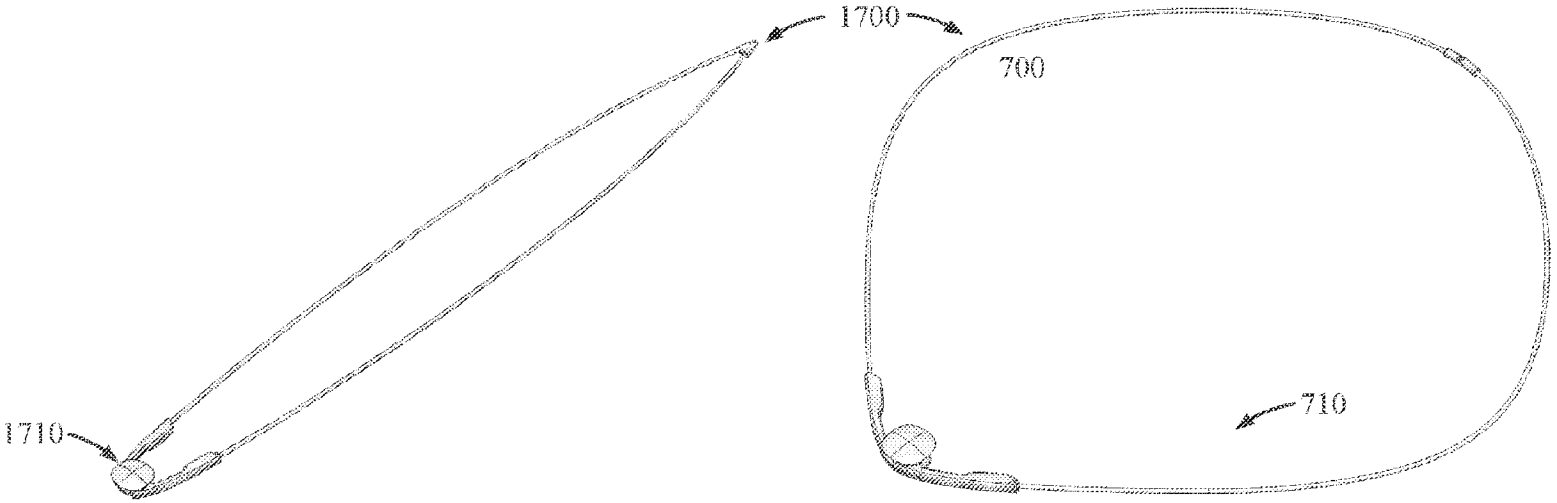
FIG. 17 illustrates a parasol frame that is collapsible.

In some embodiments, the parasol 1600 can be folded for easy storage and transportation. For example, FIG. 17 illustrates an embodiment of the parasol frame 1700 that is collapsible. The parasol frame 1700 may be made of metal, such as spring steel or aluminum. Alternatively, or in addition, the parasol frame 1700 may be made of plastic or a composite. The parasol 1600 may have a tensioner 1710 that forces the parasol frame 1700 open. For example, the tensioner 1710 may have an elastic fastener that connects the tensioner 1710 to a coupling member on the canopy 1615. In some embodiments, the tensioner 1710 may hold the parasol frame open in adverse weather conditions.

Figure 18:
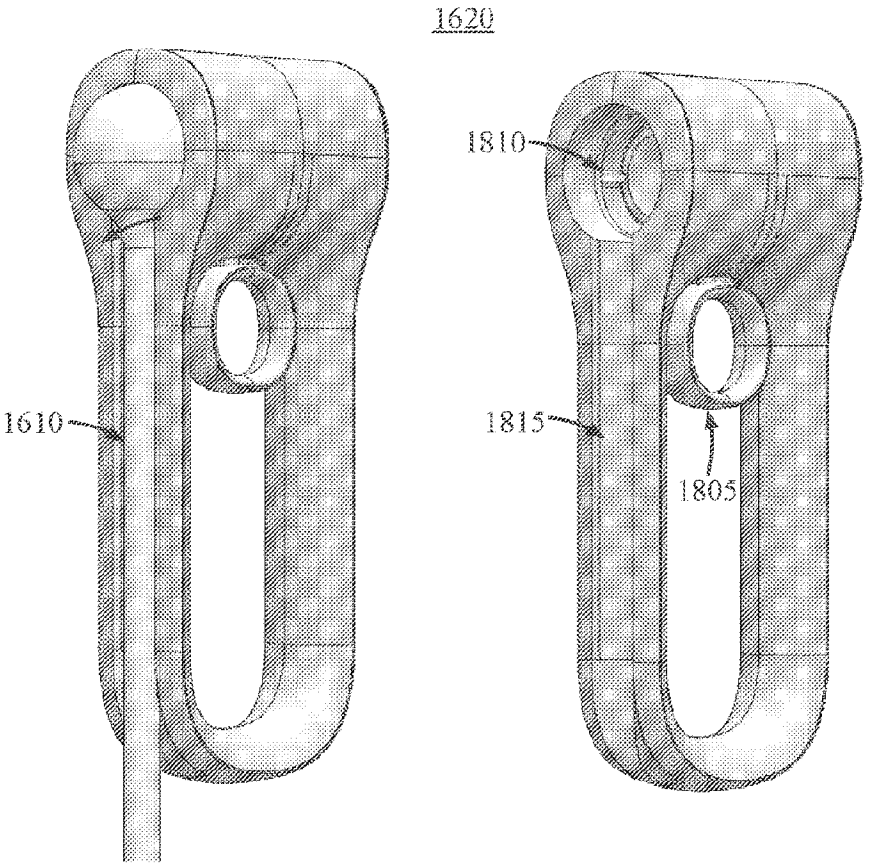
FIG. 18 illustrates a handle that is configured to receive a portion of the supporting rod in a storage groove when the parasol is folded.

FIG. 18 illustrates a handle 1620 that is configured to receive a portion of the supporting rod 1610 in a storage groove 1815 when the parasol 1600 is folded. The handle 1620 may also, or alternatively, have an attachment trigger 1805 to separate the ball joint 1605 from the handle 1620. For example, the attachment trigger may release a spring-loaded locking pin within the handle 1620 that unlocks the ball joint lock 1810. Thus, a user may break down the parasol 1600 into multiple parts.

Figure 19:
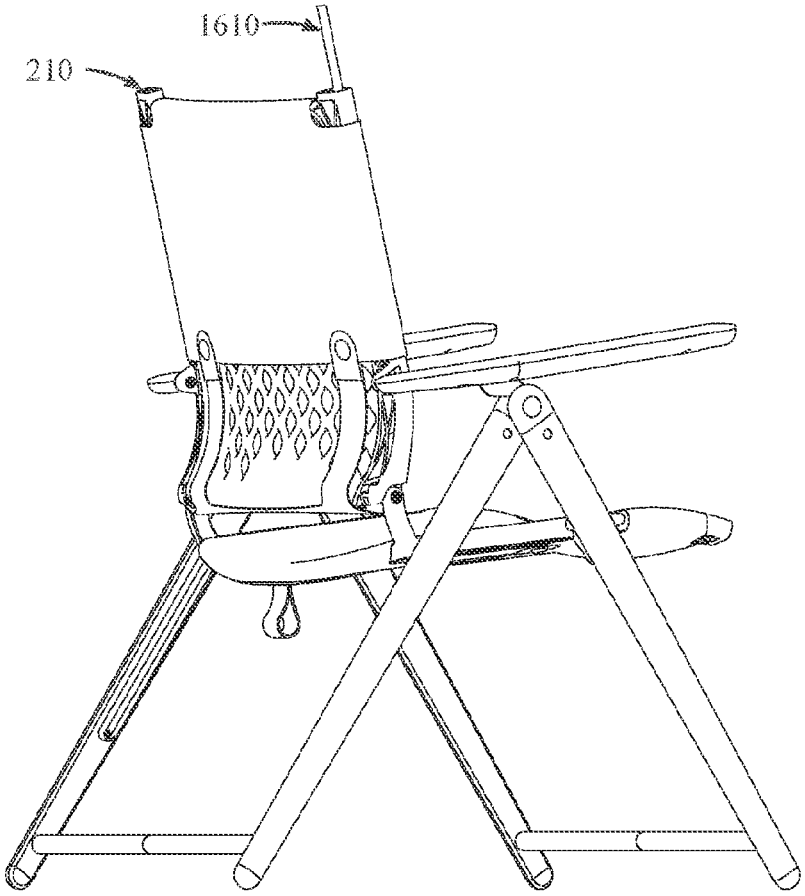
FIG. 19 illustrates a back perspective view of the foldable chair that has the parasol attached.

FIG. 19 illustrates a back perspective view of the foldable chair 100 that has the parasol 1600 attached. More specifically, the supporting rod 1610 has been inserted into the top connector 210.

In conclusion, the customizable foldable chair 100 provides a convenient and versatile solution for outdoor seating, comfort, and shade. The foldable chair 100 and its accessories (such as the parasol 1600 and cup holder 1500) can be easily collapsed and stored in a compact form, making the foldable chair 100 ideal for use at the beach, on a patio, or in other outdoor or indoor settings. The foldable chair 100 is sturdy and comfortable, and the accessories may be conveniently attached in a secure manner so that the connected accessory is able to withstand windy and adverse weather conditions. Thus, the foldable chair 100 may provide reliable shade and protection from the sun and other elements, as well as entertainment and comfort.

Figure 20:
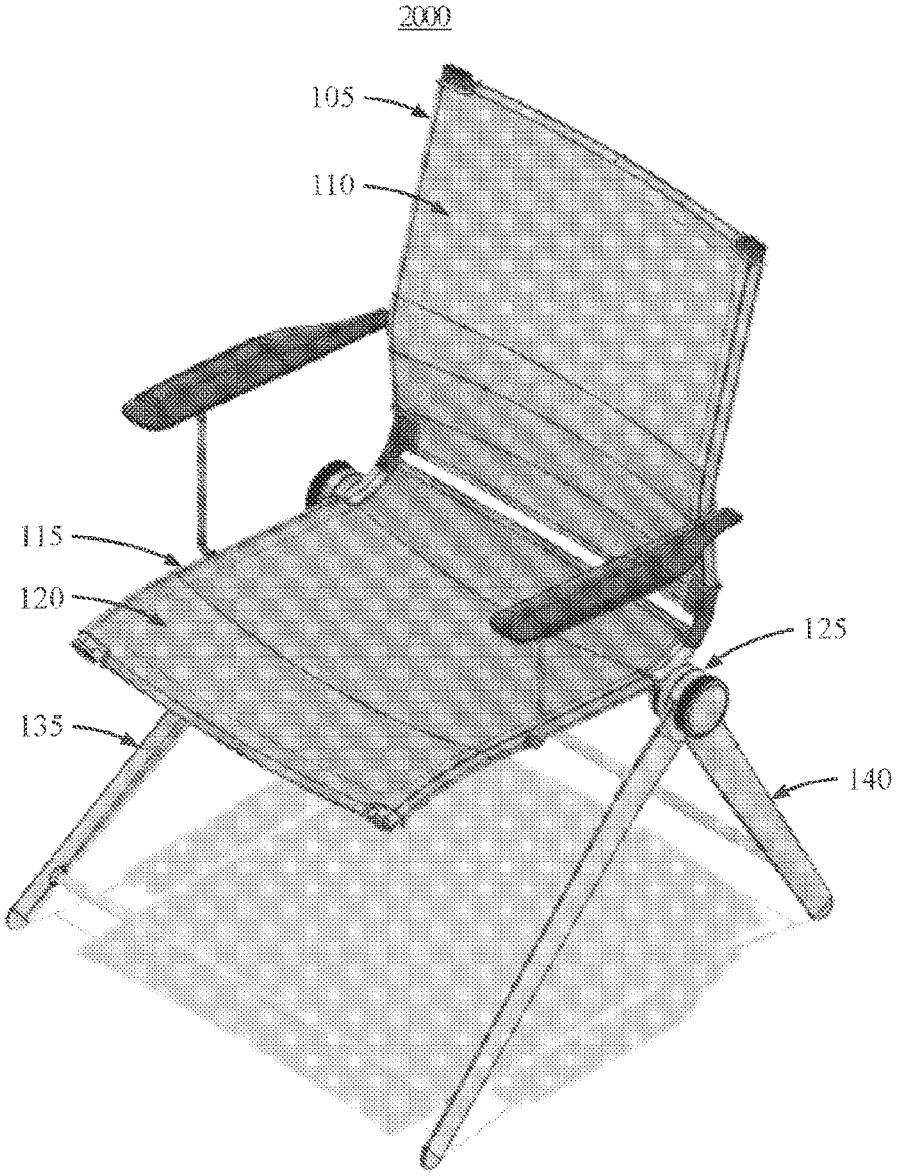
FIG. 20 illustrates a perspective view of the foldable chair in an unfolded configuration (e.g., a primary seating configuration).

FIG. 20 illustrates a perspective view of the foldable chair 2000 in an unfolded configuration (e.g., a primary seating configuration). In some embodiments, the foldable chair 2000 has of a seat back 105, a seat bottom 115, a hinge mechanism 125, front legs 135, and back legs 140. The seat back 105 has a seat back frame (not shown) and a seat back fabric 110. The seat back fabric 110 can resiliently couple to the seat back frame in a taut configuration. The stretched seat back fabric 110 creates and/or defines the surface of the seat back 105. Similarly, the seat bottom 115 has a seat bottom frame (not shown) and a seat bottom fabric 120. The seat bottom fabric 120 can also resiliently couple to the seat bottom frame in a taut configuration. The stretched seat bottom fabric 120 creates and/or defines the surface of the seat bottom 115. The seat's frame and fabric will be discussed in greater detail below.

The seat back 105, seat bottom 115, front legs 135, and back legs 140 each attach to different portions of the hinge mechanism 125. For example, the front legs 135 and back legs 140 are attached, via the hinge mechanism, to the left and right side of the seat bottom frame and seat back frame. Thus, the different foldable chair components can be adjusted (e.g., rotated) independently of each other. The independent movement of the foldable chair components allows the foldable chair 2000 to be positioned in different configurations. For example, the foldable chair can be put into a low, middle, or high vertical position by adjusting the angles of the front legs 135 and back legs 140. However, the chair 2000 can be adjusted between more or fewer positions than this (e.g., a plurality of different height positions, such as 2 or more. 3 or more. 4 or more. 5 or more different heights, etc.). The chair 2000 can also be put into a reclined position by adjusting the angle of the seat back 105 relative to the seat bottom 115. In some embodiments, the seat back 105 has a position lock that prevents the seat back 105 from being moved when the position lock is engaged. In some embodiments, the position lock is disengaged a hinge mechanism (e.g., the hinge mechanism may be pulled or actuated to disengage the position lock). Alternatively, or in addition, the position lock may be disengaged via the release tag 305 (see FIG. 9). In some embodiments, the user may disengaged the position lock by lifting or lowering one or more arm rests. For example, the arm rests may be connected to one or more pull wires (not shown) that are connected to one or more spring-loaded pins. Lifting the arm rests may pull the spring-loaded pins from their corresponding pin slots to unlock the position seat back 105. Furthermore, by aligning the different foldable chair components (e.g., the seat back 105, seat bottom 115, front legs 135, and back legs 140) the foldable chair can be moved into a folded configuration (see e.g., FIG. 3). The foldable chair's 2000 different configurations will be described more fully below.

In some embodiments, the foldable chair components each have multiple connection points with the hinge mechanism 125. For example, the seat back 105 can connect to the hinge mechanism 125 through a left connection point and a right connection point. Additionally, in some embodiments, the seat back 105, seat bottom 115, front legs 135, and back legs 140 are made of a lightweight and durable material, such as carbon fiber or aluminum. The foldable chair components can also be made of wood, plastic, metal, or a composite. Overall, the durability of the foldable chair 2000 allows the chair 2000 to support weights up to approximately 110-185 kilograms (kg), such as about 160 kg.

Figure 21A:
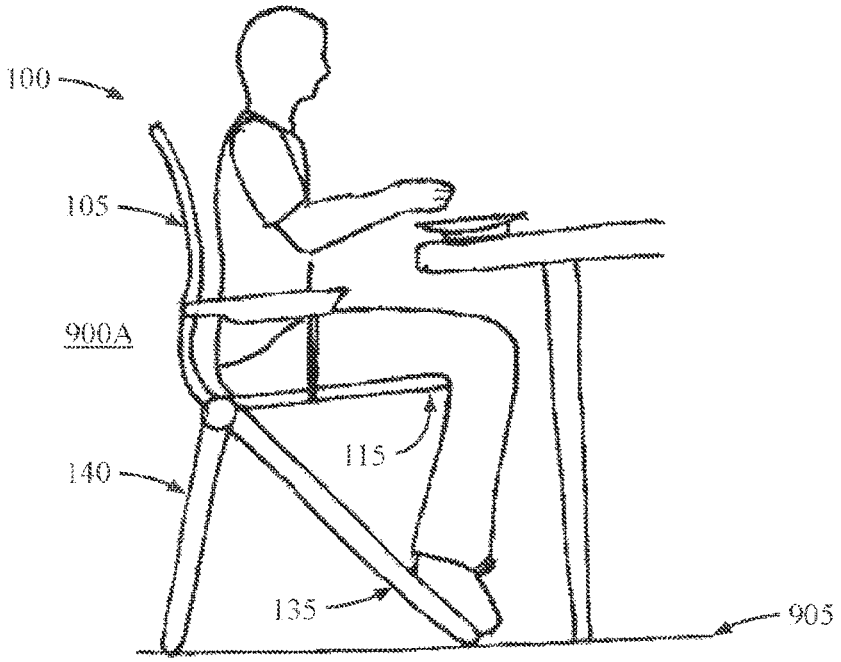
FIG. 21A illustrates a side view of the high vertical position.
Figure 21B:
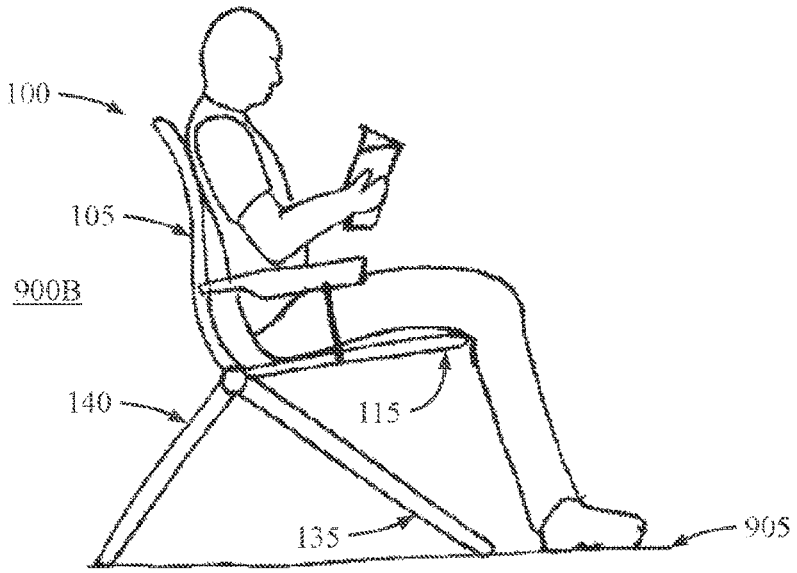
FIG. 21B illustrates a side view of the middle vertical position.
Figure 22:
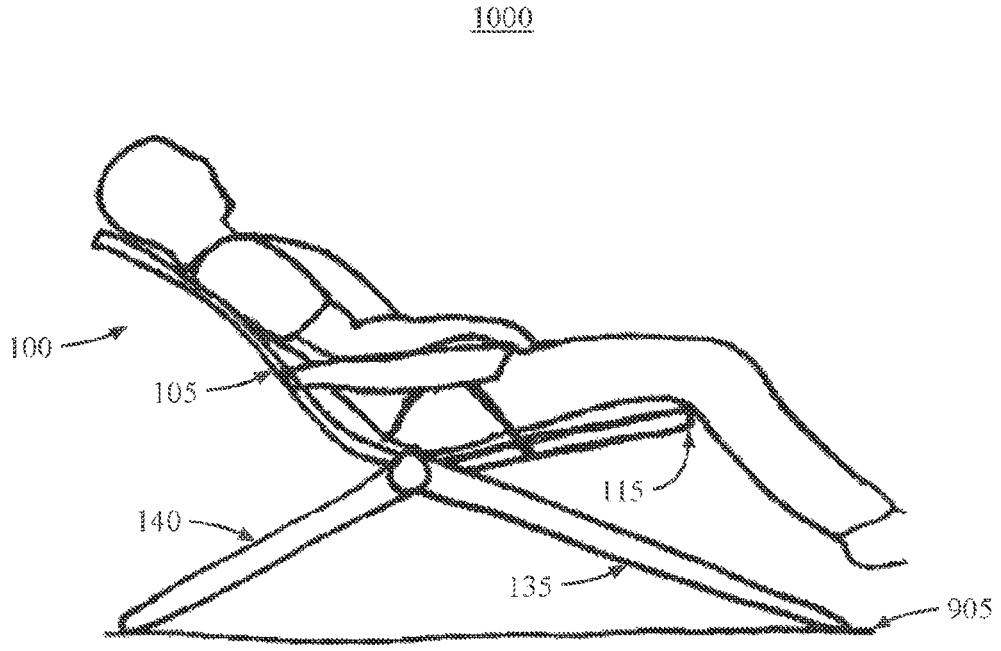
FIG. 22 illustrates a side view of the low vertical position.

The foldable chair 2000 has two or more vertical positions. In other words, the height of the seat bottom 115 above a support surface 905 (e.g., ground surface) can be adjusted by the user. FIGS. 21A, 21B, and 22 illustrate three of these vertical positions. FIG. 21A illustrates a side view of the high vertical position 900A. When the foldable chair 2000 is in the high vertical position 900A, the top of the seat bottom 115 can in one implementation be approximately 40 cm-52 cm above the support surface 905, such as about 45 cm. As seen in FIG. 21A, the high vertical position 900A may be used in connection with a table. More specifically, the high vertical position 900A puts the user at a comfortable height from a table's surface while giving enough room for a user's legs to slide underneath the table. Additionally, the high vertical position 900A may be the most comfortable position for tall users.

To put the foldable chair 2000 in the high vertical position 900A, the angle between the front legs 135 and back legs 140 is reduced. More specifically, the angle between the front legs 135 and back legs 140 is approximately 55°-65°, such as about 59°. In some embodiments, the range of the recline angle of the seat back 105 may be restricted in the high vertical position 900A to prevent the foldable chair 2000 from tipping over. In other embodiments, the seat back 105 is locked in a single position when the chair is in the high vertical position 900A. However, in some embodiments, the range of the recline angle is not restricted in the high vertical position 900A.

FIG. 21B illustrates a side view of the middle vertical position 900B. In the middle vertical position 900B, the top of the seat bottom 115 can in one implementation be approximately 32 cm-45 cm above the support surface 905, such as about 40 cm above the support surface 905. In the middle vertical position 900B, the angle between the front legs 135 and the back legs 140 is approximately 65°-120°, such as about 90°. In some embodiments, the range of the recline angle of the seat back 105 in the middle vertical position 900B may be greater than that of the chair 2000 in the high vertical position 900A, but can be restricted to prevent the foldable chair 2000 from tipping over. In other embodiments, the seat back 105 is locked in a single position when the chair is in the middle vertical position 900B. However, in some embodiments, the range of the recline angle is not restricted in the middle vertical position 900B.

FIG. 22 illustrates a side view of the low vertical position 1000. In the low vertical position 1000, the top of the seat bottom 115 can in one implementation be approximately 15 cm-35 cm above the support surface 905, such as about 30 cm above the support surface 905. In the low vertical position 1000, the angle between the front legs 135 and the back legs 140 is approximately 110°-155°, such as about 132°. In some embodiments, the recline angle of the seat back 105 is not restricted in the low vertical position 1000, and can be greater than that of the chair 2000 in the high and middle vertical positions 900A, 900B. In other words, the seat back 105 can recline to a generally horizontal position. In some embodiments, the seat back 105 can recline to a negative angle (e.g., a position past horizontal where the user's head is place below his chest). Overall, the low vertical position 1000 allows a user to relax by sitting in a reclined position (e.g., while outdoors, such as at the beach, at the park, while camping, etc.).

Figure 23:
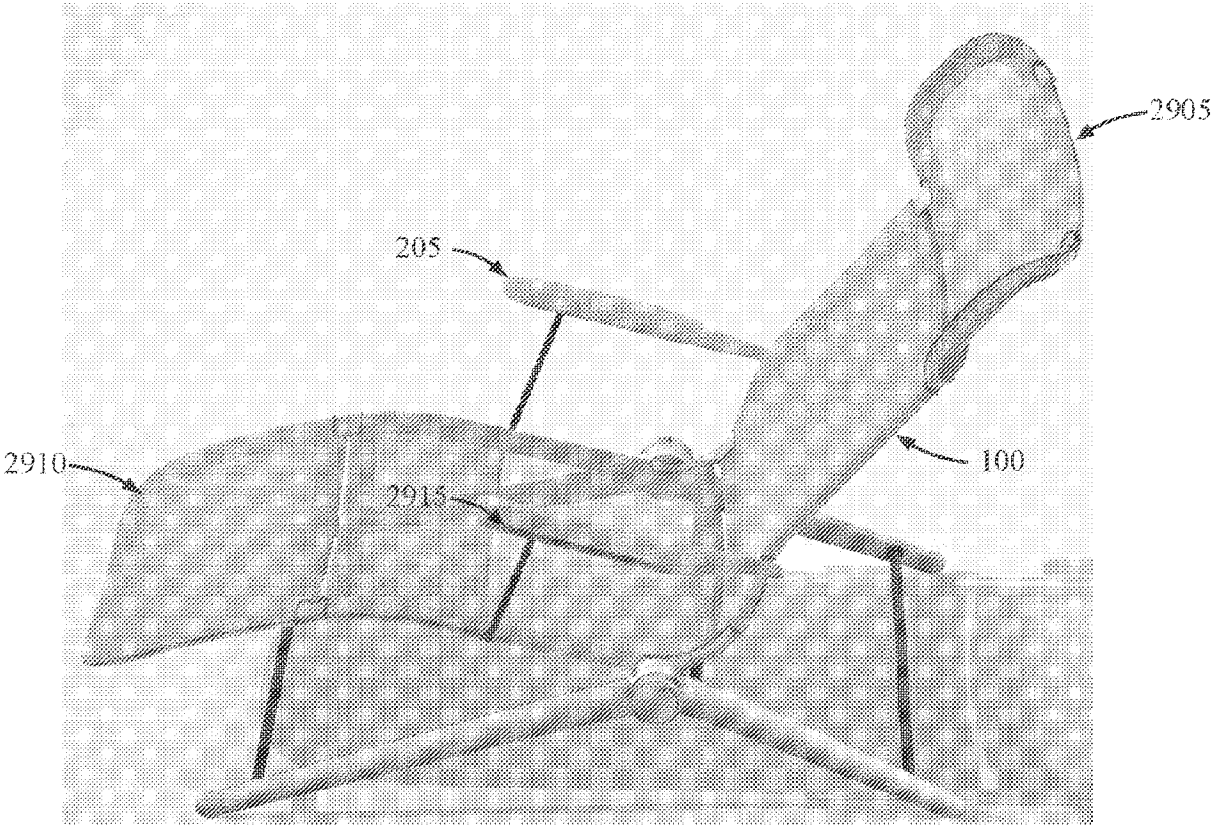
FIG. 23 illustrates one embodiment of a foldable chair with a head rest and footrest.
Figure 24A:
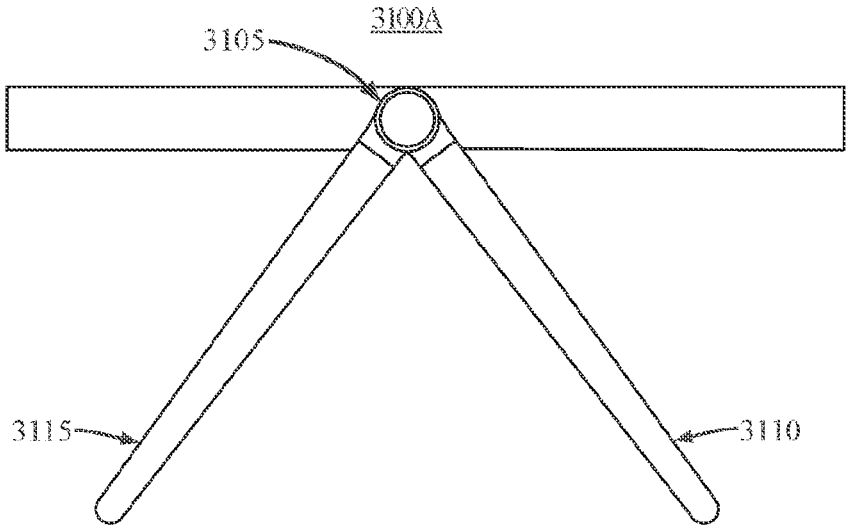
FIGS. 24A-25B illustrate a foldable table that has a hinge mechanism with a rotatable knob, and a pair of front legs and a pair of rear legs.
Figure 24B:
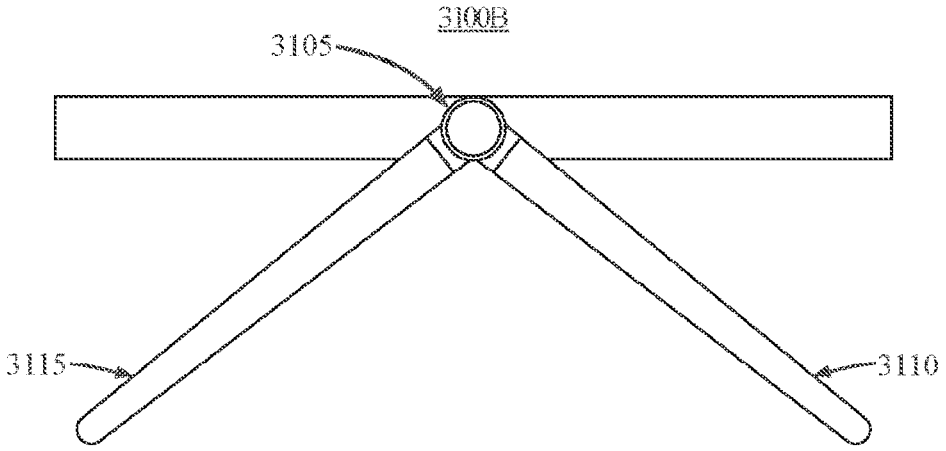
Figure 25A:
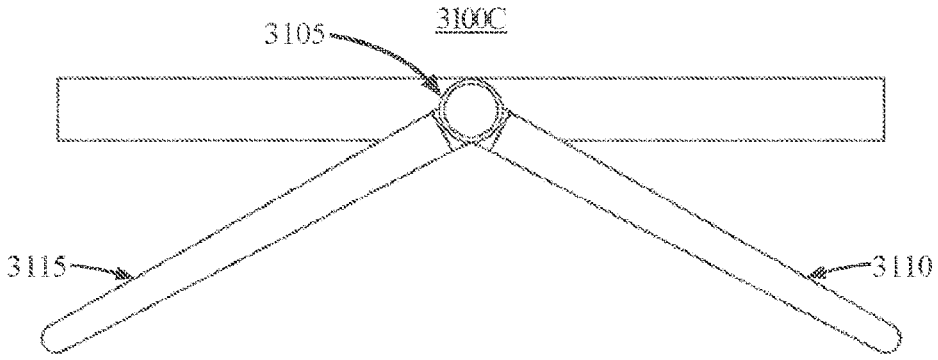
Figure 25B:
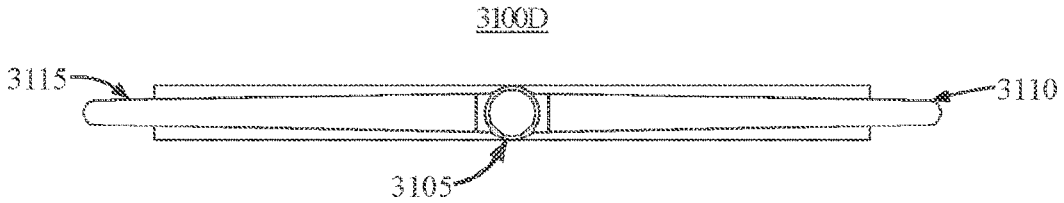

FIG. 23 illustrates one embodiment of a foldable chair 2000 with a head rest 2905 and footrest 2910. In some embodiments, the head rest 2905 attaches to both top attachment points or connectors 210. Similarly, the footrest 2910 can be attached to both bottom attachment points or connectors 215. Having an accessory attached to more than one attachment point improves the stability and strength of the connection. Thus, the head rest 2905 and footrest 2910 will remain attached even under a significant load (e.g., 20-50 kg). However, in some embodiments, a head rest or footrest can be attached to the foldable chair 2000 using a single attachment point.

In some embodiments, the foldable chair 2000 also has attachment slots 2915. The attachment slots 2915 can resiliently couple to chair accessories. In some embodiments, the attachment slots 2915 are positioned on, or defined in, the side of the arm rests 205. The attachment slots may also be positioned on the top of the arm rests 205 or on the side of the seat bottom 115 or seat back 105. In another implementation, the foldable chair 2000 has one or more attachment points located on the bottom of the arm rests 205. Additionally, the attachment points and slots may be used while the foldable chair 2000 is in any configuration. In some embodiments, the attachment slots 2915 connect to the chair accessories using magnets, slots and tabs, a snapping mechanism, a friction fit, a screwing mechanism, or a combination of these methods. Though FIGS. 20-23 show the foldable chair 2000, one of skill in the art will recognize that the foldable chair 100 may have similar features and advantages, such as two or more vertical positions.

The features and advantages described above can also be applied to a foldable table. FIGS. 24A-25B illustrate a foldable table 3100A-3100D that has a hinge mechanism 3105 with a rotatable knob, and a pair of front legs 3110 and a pair of rear legs 3115. The hinge mechanism has all the functionality of the hinge mechanisms (e.g., 125, 1900A, 1900B, 2100, 2300A, and 2300B) described above. For example, in some embodiments, the hinge mechanism can have one or more pins with corresponding slots, and a rotatable knob that adjusts the position of the one or more pins and the corresponding slots. The hinge mechanism 125 may also use one or more gears or a mechanical linkage assembly. In some embodiments, a user actuates the hinge mechanism by axially pulling on the rotatable knob to unlock the hinge mechanism and then rotates the knob to select a new configuration. When the user stops axially pulling the rotatable knob, the hinge mechanism automatically locks back in place.

In some embodiments, the user can configure the table surface to have a vertical height of between 10-75 cm, such as 40 cm. In other words, the user can select any vertical height between the table's minimum and maximum height. In other embodiments, the foldable table has two or more discrete positions. For example, the table may have a high vertical position 3100A, middle vertical position 3100B, low vertical position 3100C, and folded position 3100D. In the folded position 3100D the first axis of the table (e.g., the axis that is perpendicular to the hinge axis) is generally aligned with the pair of front legs and the pair of rear legs. Additionally, in the unfolded configurations (3100A-3100C) the legs are not generally aligned with the first axis of the table.

In some embodiments, the foldable table 3100A-3100D also has a removable fabric (e.g., similar to the fabric 110, 120) that couples to the table surface frame (not shown). Thus, like the foldable chair 2000 the foldable table 3100A-3100D allows a user to easily customize and/or repair the table. Overall, the foldable chair and table are easily used, transported, and stored.

ADDITIONAL EMBODIMENTS

In embodiments of the present disclosure, a customizable foldable chair or table may be in accordance with any of the following clauses:

Clause 1. A foldable chair, comprising: a seat back and a seat bottom, the foldable chair movable between a folded configuration where the seat bottom and seat back are generally adjacent to each other and a primary seating configuration where the seat bottom extends generally perpendicular to the seat back: a first cover removably coupleable to the seat bottom having a first sleeve pocket that extends over at least a portion of the seat bottom and one or more straps extending from one or more edges of a front of the first cover and wrapping around an edge of the seat bottom, the straps comprising coupling members configured to couple to corresponding coupling elements on an underside of the seat bottom to resiliently couple the first cover to the seat bottom: a second cover removably coupleable to the seat back having a second sleeve pocket that extends over at least a portion of the seat back and one or more straps extending from one or more edges of a front of the second cover and wrapping around an edge of the seat back, the straps comprising coupling members configured to couple to corresponding coupling elements on a back of the seat back to resiliently couple the second cover to the seat back; and a pair of front legs coupled to a pair of rear legs via a hinge mechanism and attached to a left and right side of the foldable chair.

Clause 2. The foldable chair of clause 1, wherein the foldable chair further comprises a locking mechanism, wherein the locking mechanism is selectively unlocked by actuating a release tag.

Clause 3. The foldable chair of clause 2, wherein the release tag is attached to a pull wire attached to one or more spring-loaded pins, wherein the one or more spring-loaded pins have corresponding slots that restrict a movement of the corresponding one or more pins, and wherein actuating the release tag disengages the one or more spring-loaded pins from the corresponding slots.

Clause 4. The foldable chair of any preceding clause, wherein the coupling members of the first cover and the second cover are elastic hoops, and wherein the coupling elements on the back of the seat bottom and the seat back are protrusions configured to couple to the elastic hoops.

Clause 5. The foldable chair of any preceding clause, wherein the coupling members on the front of the first cover and the second cover are separable magnet fasteners configured to couple to the corresponding coupling elements on the back of the seat bottom and seat back.

Clause 6. The foldable chair of any preceding clause, wherein the seat back comprises one or more top connectors, wherein the one or more top connectors are configured to resiliently couple to a parasol.

Clause 7. The foldable chair of clause 6, wherein the parasol is collapsible.

Clause 8. The foldable chair of any preceding clause, wherein the foldable chair further comprises of a pair of arm rests, wherein the arm rests comprise of one or more connectors that are located on a distal portion of the arm rests.

Clause 9. The foldable chair of clause 8, wherein the one or more connectors are located on an underside of the arm rests.

Clause 10. A foldable chair, comprising: a frame including a seat back and a seat bottom, the frame movable between a folded configuration where the seat bottom and seat back are generally adjacent to each other and a primary seating configuration where the seat bottom extends generally perpendicular to the seat back: a pair of front legs coupled to a pair of rear legs via a hinge mechanism and attached to a left and right side of the seat bottom; and one or more connectors, at least one of the one or more connectors being on the seat back or seat bottom of the frame that are configured to removably couple to an accessory.

Clause 11. The foldable chair of any preceding clause, wherein the foldable chair further comprises a locking mechanism, wherein the locking mechanism may be unlocked by actuating a release tag.

Clause 12. The foldable chair of clause 11, wherein the release tag is attached to a pull wire attached to one or more spring-loaded pins, wherein the one or more spring-loaded pins have corresponding slots that restrict a movement of the corresponding spring-loaded pin, and wherein actuating the release tag disengages the one or more spring-loaded pins from the corresponding slots.

Clause 13. The foldable chair of any preceding clause, wherein the foldable chair further comprises a locking mechanism, wherein the locking mechanism automatically locks when either the folded configuration or the primary seating configuration is reached.

Clause 14. The foldable chair of any preceding clause, wherein the one or more connectors located on a top portion of the seat back, wherein the one or more connectors are configured to receive a parasol.

Clause 15. The foldable chair of any preceding clause, wherein the foldable chair further comprises of a pair of arm rests, wherein the one or more connectors include a connector located on a distal portion of one arm rest of the pair of arm rests.

Clause 16. The foldable chair of clause 15, wherein the connector located on the distal portion of the arm rest is located on an underside of the arm rest.

Clause 17. The foldable chair of clause 16, wherein the connector is configured to receive a cup holder.

Clause 18. A cover removably coupleable to a chair, the cover comprising: a first cover portion removably coupleable to a seat bottom having a first sleeve pocket that extends over at least a portion of the seat bottom and one or more straps extending from one or more edges of a front of the first cover portion and wrapping around an edge of the seat bottom, the straps comprising coupling members configured to couple to corresponding coupling elements on a back of the first cover portion to resiliently couple the first cover portion to the seat bottom; and a second cover portion removably coupleable to a seat back having a second sleeve pocket that extends over at least a portion of the seat back and one or more straps extending from one or more edges of a front of the second cover portion and wrapping around an edge of the seat back, the straps comprising coupling members configured to couple to corresponding coupling elements on a back of the second cover portion to resiliently couple the second cover portion to the seat back.

Clause 19. The cover of any preceding clause, wherein the first cover portion and the second cover portion are made of a mesh material.

Clause 20. The cover of any preceding clause, wherein the coupling members on the front of the first cover portion and the second cover portion are elastic hoops, and wherein the coupling elements on the back of the first cover portion and the second cover portion are protrusions configured to resiliently couple to the elastic hoops.

Clause 21. The cover of any preceding clause, wherein the coupling members on the front of the first cover and the second cover are separable magnet fasteners configured to resiliently couple to corresponding coupling elements on the back of the first cover and the second cover.

Clause 22. The cover of any preceding clause, wherein the one or more coupling members on the front of the first cover portion and the second cover portion are snap-fit fasteners configured to resiliently couple to corresponding coupling elements on the back of the first cover portion and the second cover portion.

Clause 23. The cover of any preceding clause, wherein the coupling members of the first cover and the second cover are a first side a zipper configured to resiliently couple to corresponding coupling elements on the back of the first cover and the second cover, wherein the corresponding coupling elements are a second side of the zipper While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Of course, the foregoing description is that of certain features, aspects and advantages of the present invention, to which various changes and modifications can be made without departing from the spirit and scope of the present invention. Moreover, the devices described herein need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed devices.

What is claimed is:

1. A foldable chair, comprising:

a frame including a seat back and a seat bottom, the frame movable between a folded configuration where the seat bottom and seat back are adjacent each other and a seating configuration where the seat bottom extends perpendicular to the seat back;

a pair of front legs coupled to a pair of rear legs via a hinge mechanism and attached to a left side and a right side of the seat bottom; and one or more connectors on one or both of the seat back and the seat bottom configured to removably couple to an accessory;

wherein:

the foldable chair further comprises of a pair of arm rests, one or both of the arm rests include a connector configured to couple to another accessory, said another accessory being a cup holder, and the cup holder comprises a coupling member via which the cup holder couples to the connector, a main body with an opening configured to receive a beverage container, and a wine glass holder comprising a ring rotatably coupled to the main body and a flange with a slot that extends outward relative to the opening and is configured to receive a stem of a wine glass.

2. The foldable chair of claim 1, wherein the foldable chair further comprises a locking mechanism, wherein the locking mechanism may be unlocked by actuating a release tag.

3. The foldable chair of claim 2, wherein the release tag is located adjacent to a rear edge of the seat bottom.

4. The foldable chair of claim 2, wherein the release tag is attached to a pull wire attached to one or more spring-loaded pins, wherein each of the one or more spring-loaded pins have corresponding one or more slots that restricts a movement of the one or more spring-loaded pins, and wherein actuating the release tag disengages the one or more spring-loaded pins from the corresponding one or more slots.

5. The foldable chair of claim 1, wherein the foldable chair further comprises a locking mechanism, wherein the locking mechanism automatically locks when either the folded configuration or the seating configuration is reached.

6. The foldable chair of claim 1, wherein the one or more connectors are located on a top portion of the seat back, wherein the one or more connectors are configured to couple to a parasol.

7. The foldable chair of claim 1, wherein the connector of one or both of the arm rests is located on an underside of the arm rest.

8. The foldable chair of claim 1, wherein the flange is C-shaped.

9. The foldable chair of claim 1, wherein the accessory is a parasol configured to removably couple to the seat back via one of the one or more connectors.

10. A foldable chair, comprising:

a frame including a seat back and a seat bottom, the frame movable between a folded configuration where the seat bottom and seat back are adjacent each other and a seating configuration where the seat bottom extends perpendicular to the seat back;

a pair of front legs coupled to a pair of rear legs via a hinge mechanism and attached to a left side and a right side of the seat bottom;

one or more connectors on one or both of the seat back and the seat bottom configured to removably couple to an accessory; and at least one cover removably coupleable to the foldable chair, the at least one cover comprising a first cover portion removably coupleable to a seat bottom comprising a first sleeve pocket extending over at least a portion of the seat bottom, and a second cover portion removably coupleable to a seat back having a second sleeve pocket extending over at least a portion of the seat back;

wherein:

the foldable chair further comprises a pair of arm rests, wherein one or both of the arm rests include a connector configured to couple to a cup holder, and the cup holder comprises a coupling member via which the cup holder couples to the connector, a main body with an opening configured to receive a beverage container, and a wine glass holder comprising a ring rotatably coupled to the main body and a C-shaped flange with a slot that extends outward relative to the opening and is configured to receive a stem of a wine glass.

11. The foldable chair of claim 10, wherein the at least one cover is a plurality of covers, each having a different design.

12. The foldable chair of claim 10, wherein the first cover portion removably coupleable to the seat bottom further comprises one or more openings configured to align with the one or more connectors to allow the one or more connectors to extend through the one or more openings to allow the seat bottom to couple to the accessory with the one or more connectors.

13. The foldable chair of claim 12, wherein the accessory is a footrest configured to removably couple to the one or more connectors of the seat bottom.

14. The foldable chair of claim 10, wherein the second cover portion removably coupleable to the seat back further comprises one or more openings configured to align with the one or more connectors to allow the one or more connectors to extend through the one or more openings to allow the seat back to couple to the accessory with the one or more connectors.

15. The foldable chair of claim 14, wherein the accessory is a head rest configured to removably couple to the one or more connectors of the seat back.

* * * * *